US008434862B2

(12) United States Patent
Izuma et al.

(10) Patent No.: US 8,434,862 B2
(45) Date of Patent: May 7, 2013

(54) IMAGE FORMING APPARATUS

(75) Inventors: Kensuke Izuma, Tama (JP); Junichi Nakamura, Bando (JP); Yoshiharu Yamashita, Mitaka (JP); Hisaya Sorita, Misato (JP); Yuichi Takahashi, Yoshikawa (JP); Iwao Kawamura, Kunitachi (JP)

(73) Assignee: Canon Finetech Inc., Saitama-Ken (JP)

( * ) Notice: Subject to any disclaimer, the term of this patent is extended or adjusted under 35 U.S.C. 154(b) by 146 days.

(21) Appl. No.: 12/945,535

(22) Filed: Nov. 12, 2010

(65) Prior Publication Data

US 2011/0115866 A1 May 19, 2011

(30) Foreign Application Priority Data

Nov. 17, 2009 (JP) ..... 2009-262221
Oct. 29, 2010 (JP) ..... 2010-244603

(51) Int. Cl.
*B41J 2/01* (2006.01)
*B41J 29/13* (2006.01)

(52) U.S. Cl.
USPC ..... 347/104; 347/101; 347/108

(58) Field of Classification Search ..... 347/108
See application file for complete search history.

(56) References Cited

U.S. PATENT DOCUMENTS 1,921,690 A * 8/1933 Miller ..... 312/272
4,589,758 A * 5/1986 Kasama et al. ..... 399/122
4,754,290 A * 6/1988 Kitayama et al. ..... 347/222
4,796,037 A * 1/1989 Takada et al. ..... 347/138
5,238,317 A * 8/1993 Bohmer et al. ..... 400/693
5,393,152 A * 2/1995 Hattori et al. ..... 400/691
5,454,553 A * 10/1995 Firl et al. ..... 271/4.04
5,532,826 A * 7/1996 Miyao et al. ..... 358/296
5,614,992 A * 3/1997 Kikuchi et al. ..... 399/124
6,290,409 B1 * 9/2001 Osmus ..... 400/624

(Continued)

FOREIGN PATENT DOCUMENTS

CN 1835846 A 9/2006
EP 0879706 A2 11/1998

(Continued)

OTHER PUBLICATIONS

Search Report which issued on Nov. 7, 2011, in counterpart European application No. 10191357.

(Continued)

*Primary Examiner* — Stephen Meier
*Assistant Examiner* — Leonard S Liang
(74) *Attorney, Agent, or Firm* — Fitzpatrick, Cella, Harper & Scinto

(57) ABSTRACT

An image forming apparatus, including: a recording unit configured to form an image on a recording medium conveying in a conveying direction; a main body portion configured to support the recording unit in an openable and closable manner; a conveying unit configured to convey, in the conveying direction, the recording medium on which an image is to be formed by the recording unit, the conveying unit being disposed below the recording unit; a holder configured to contain the recording medium on which an image is to be formed by the recording unit, the holder being disposed upstream of the conveying unit in the conveying direction; and a raising and lowering mechanism configured to raise and lower the holder between a first position for feeding the recording medium to the recording unit and a second position placed above the first position.

10 Claims, 23 Drawing Sheets

U.S. PATENT DOCUMENTS

| | | | | |
|---|---|---|---|---|
| 6,419,410 | B1 * | 7/2002 | Osmus et al. | 400/624 |
| 6,758,545 | B2 * | 7/2004 | Ikeda et al. | 347/16 |
| 7,556,370 | B2 * | 7/2009 | Silverbrook et al. | 347/108 |
| 8,118,423 | B2 * | 2/2012 | Hiroki et al. | 347/104 |
| 2001/0017644 | A1 * | 8/2001 | Cappello et al. | 347/108 |
| 2002/0175985 | A1 * | 11/2002 | Zevin et al. | 347/104 |
| 2003/0025764 | A1 * | 2/2003 | Sturgeon et al. | 347/49 |
| 2004/0169327 | A1 * | 9/2004 | Swayze et al. | 271/145 |
| 2005/0141947 | A1 * | 6/2005 | Nishimura | 400/691 |
| 2006/0181556 | A1 * | 8/2006 | Wanibuchi et al. | 347/8 |
| 2007/0116506 | A1 * | 5/2007 | Portig et al. | 400/691 |
| 2007/0195146 | A1 * | 8/2007 | Tanabe | 347/104 |
| 2007/0195147 | A1 * | 8/2007 | Tanabe | 347/104 |

FOREIGN PATENT DOCUMENTS

| | | | |
|---|---|---|---|
| EP | 1642721 | A1 | 4/2006 |
| JP | 03-162328 | A | 7/1991 |
| JP | 06-218965 | A | 8/1994 |
| JP | 11011756 | A | 1/1999 |
| JP | 2002-193507 | A | 7/2002 |
| JP | 2004-026314 | A | 1/2004 |
| JP | 2005179042 | A | 7/2005 |
| JP | 2006-281676 | A | 10/2006 |
| JP | 2007-119117 | A | 5/2007 |

OTHER PUBLICATIONS

Office Action which issued on Nov. 22, 2011, in counterpart JPA 2010-244603.

Office Action in counterpart Chinese application No. 201010552415.4.

* cited by examiner

IMAGE FORMING APPARATUS

BACKGROUND OF THE INVENTION

1. Field of the Invention

The present invention relates to an image forming apparatus, and more particularly, to a structure configured to contain sheets.

2. Description of the Related Art

For a conventional image forming apparatus, there is a technology for supplying a recording medium such as a fan-fold paper. According to the technology, the fan-fold paper is contained in a fan-fold paper storage box placed on a placement part arranged on the rear side of a printer on a plane where the printer is placed (see Japanese Patent Application Laid-Open No. 2005-179042).

In the conventional image forming apparatus, such as an ink jet recording apparatus, in the case where a sheet feeding portion such as a recording medium feeding portion is arranged on the rear side of the apparatus main body provided with the sheet feeding portion and a delivery portion, the recording medium needs to be carried all the way across the apparatus main body to be contained in the sheet feeding portion, and hence the storage portion of the recording medium is difficult to see. Further, in the conventional image forming apparatus, the recording medium is supplied on the rear side with respect to the front side of the apparatus main body, and hence a space needs to be provided on the rear side of the apparatus main body, which requires a larger installation space for the apparatus main body.

SUMMARY OF THE INVENTION

The present invention has been made in view of the above-mentioned circumstances, and therefore, it is an object of the present invention to provide an image forming apparatus which offers excellent visibility and is capable of saving space.

According to the present invention, an image forming apparatus includes: a recording unit configured to form an image on a recording medium conveyed in a predetermined conveying direction; a main body portion configured to support the recording unit in an openable and closable manner; a conveying unit configured to convey, in the predetermined conveying direction, the recording medium on which an image is to be formed by the recording unit, the conveying unit being disposed below the recording unit; a holder configured to contain the recording medium on which an image is to be formed by the recording unit, the holder being disposed upstream of the conveying unit in the predetermined conveying direction; and a raising and lowering mechanism configured to raise and lower the holder between a first position for feeding the recording medium to the recording unit and a second position placed above the first position.

According to the present invention, there may be provided an image forming apparatus which offers excellent visibility and is capable of saving space.

Further features of the present invention will become apparent from the following description of exemplary embodiments with reference to the attached drawings.

DESCRIPTION OF THE EMBODIMENTS

Figure 1:
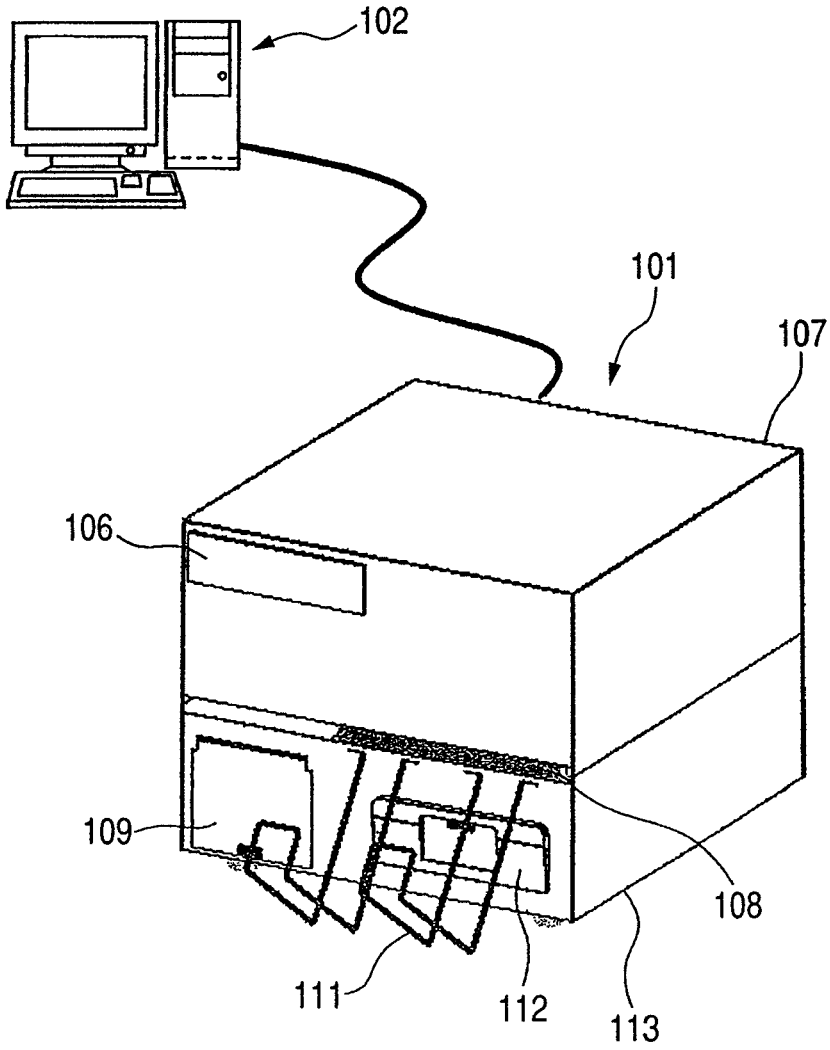
FIG. 1 is a perspective view schematically illustrating an ink jet recording apparatus as an example of an image forming apparatus according to a first embodiment of the present invention.

In the following, embodiments of the present invention will be described in detail with reference to the accompanying drawings. FIG. 1 is a perspective view schematically illustrating an ink jet recording apparatus as an example of an image forming apparatus according to a first embodiment of the present invention.

The ink jet recording apparatus 101 is connected to a host personal computer (PC) 102 for transmitting image information to the ink jet recording apparatus 101. The ink jet recording apparatus 101 includes a recording unit 107. The recording unit 107 includes a recording engine 105 serving as an image forming portion and an operation panel 106 including a display panel and a button. The recording engine 105 includes a recording head 103 of FIG. 3 to be described later, and a recovery unit 104. The recording head 103 ejects ink onto a recording medium (sheet) to thereby form an image. The recovery unit 104 maintains the printing performance of the recording head 103. The operation panel 106 is disposed on the front side of the ink jet recording apparatus 101.

The ink jet recording apparatus 101 further includes a base unit 113 serving as a main body portion. The base unit 113 includes a recording medium conveying unit 108 configured to convey the recording medium, an ink supply unit configured to supply ink to the recording head 103, a recording medium feeding unit 110 (shown in FIG. 3 which will be described later) configured to contain the recording medium, a stacker 111 configured to stack the recording medium delivered, and a waste liquid unit 112 configured to store waste ink. The recording unit 107 serving as an upper unit is provided to be openable and closable with respect to the base unit 113 serving as a lower unit. FIG. 1 illustrates a state in which the recording unit 107 is closed.

Figure 2:
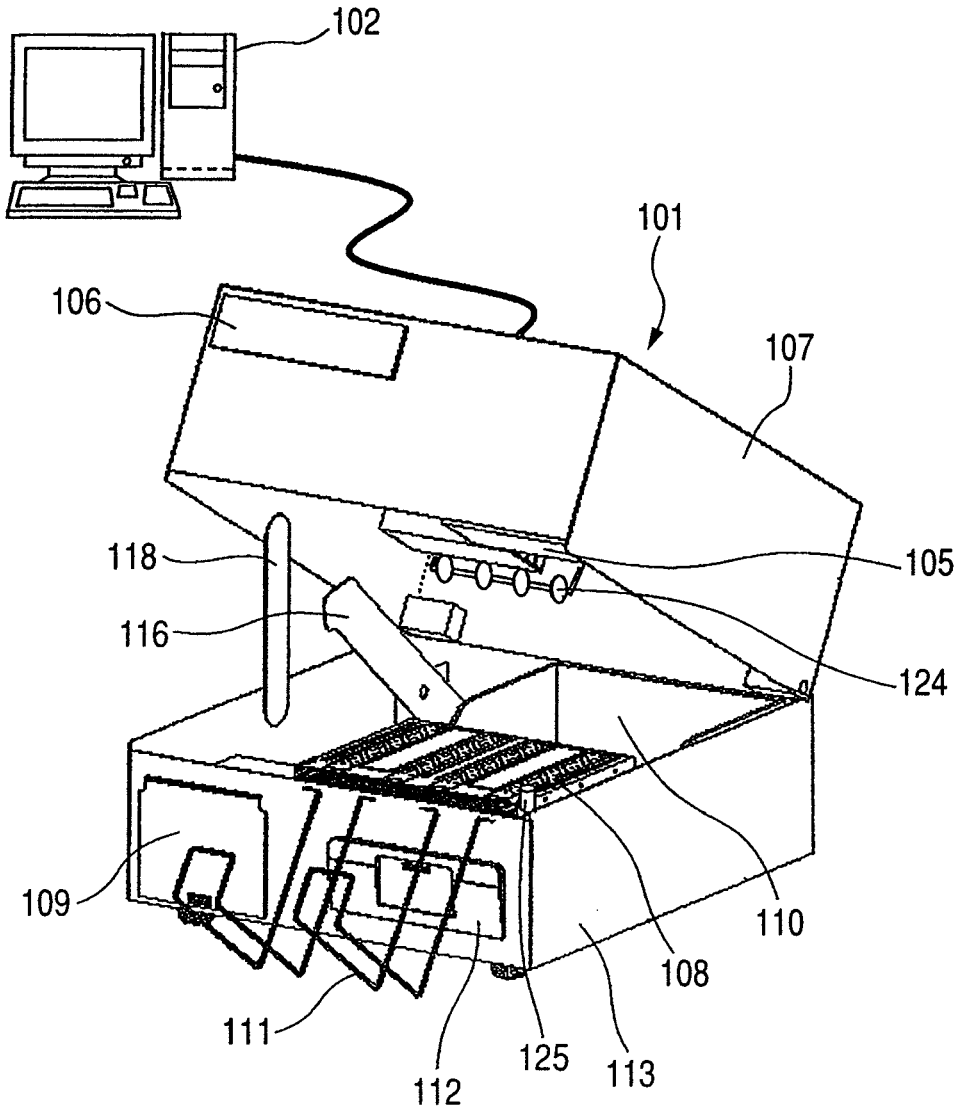
FIG. 2 is a view illustrating the ink jet recording apparatus in which a recording unit is opened.

FIG. 2 is a view illustrating the ink jet recording apparatus 101 in which the recording unit 107 is opened. In FIG. 2, the recording unit 107 is supported by a support member 118. When the recording unit 107 is opened, the recording unit 107 is supported by the support member 118 to thereby remain opened. A raising and lowering mechanism 116 raises and lowers a recording medium holder 115 of FIG. 3 which will be described later. In the first embodiment, the raising and lowering mechanism 116 is provided inside the ink jet recording apparatus 101. Note that, the raising and lowering mechanism 116 may not necessarily be provided inside the ink jet recording apparatus 101, and may be provided outside the ink jet recording apparatus 101.

The recording engine 105 and a pinch roller 124 configured to convey the recording medium are provided inside the recording unit 107. Further, the base unit 113 includes the ink supply unit 109, the waste liquid unit 112, the stacker 111, the recording medium feeding unit 110, and the raising and lowering mechanism 116, and further includes the recording medium conveying unit 108 configured to convey the recording medium. The recording engine 105 is disposed above the recording medium conveying unit 108 when the recording unit 107 is closed, and performs printing on the recording medium conveyed by the recording medium conveying unit 108. Further, the recording medium feeding unit 110 is disposed upstream of the recording medium conveying unit 108 in a direction in which the recording medium is conveyed by the recording medium conveying unit 108. Still further, the stacker 111 disposed in front of the ink jet recording apparatus 101 is disposed downstream of the recording medium conveying unit 108 in the direction in which the recording medium is conveyed by the recording medium conveying unit 108, so as to stack the recording medium delivered to the front.

Figure 3:
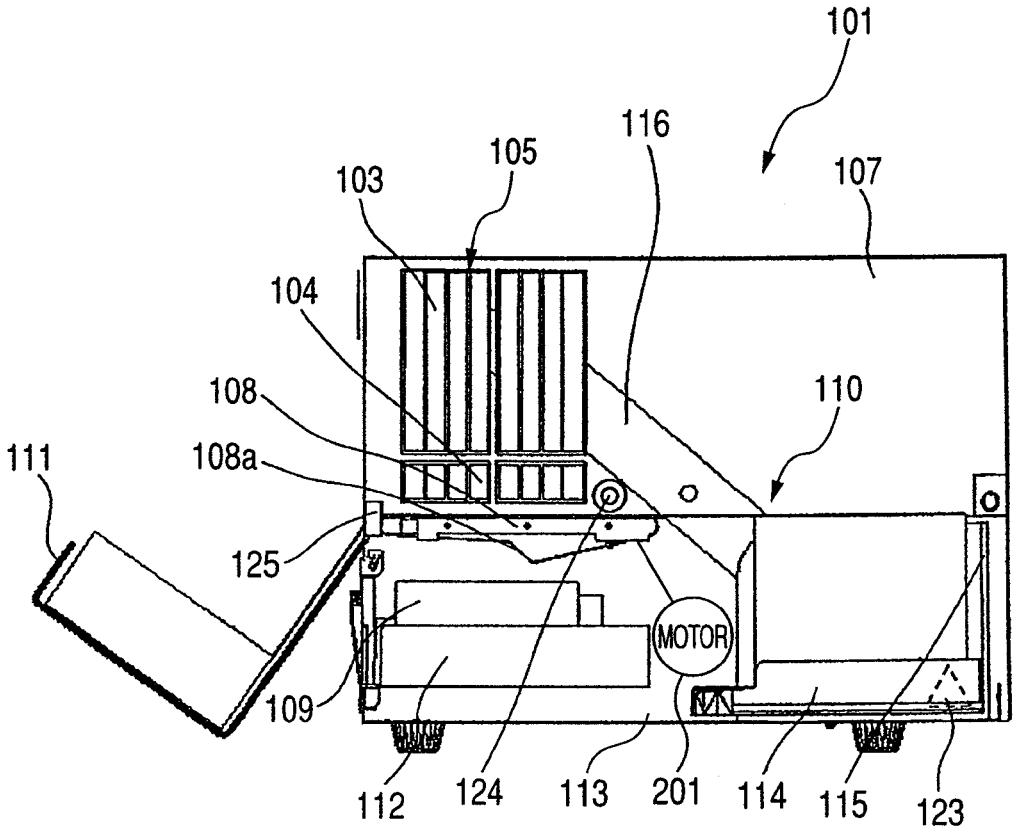
FIG. 3 is a right side sectional view of the ink jet recording apparatus.

FIG. 3 is a right side sectional view of the ink jet recording apparatus 101. The recording unit 107 includes the recording engine 105. The recording engine 105 includes the recording head 103 which ejects ink onto the recording medium to thereby form an image, and the recovery unit 104 configured to maintain the printing performance of the recording head 103. Further, the recording medium feeding unit 110 provided in the base unit 113 includes the raising and lowering mechanism 116, the recording medium tray 114 into which the recording medium is set, and the recording medium holder 115 configured to hold the recording medium tray 114. Note that, in FIG. 3, the recording medium tray 114 and the recording medium holder 115 are placed in a position capable of feeding the recording medium to the recording medium conveying unit 108. The position is hereinafter referred to as a recording medium feedable position. When the recording medium tray 114 and the recording medium holder 115 are placed in the recording medium feedable position, the recording medium tray 114 is positioned below a recording medium conveying surface of the recording medium conveying unit 108.

Here, the recording medium contained in the recording medium tray 114 is conveyed under the recording head 103 by the recording medium conveying unit 108. The recording medium conveying unit 108 includes one or more conveyor belts 108*a*, and the recording medium is conveyed along with the rotation of the conveyor belt 108*a*. Further, the conveyor belt 108*a* is configured to be rotated through the rotation of a conveyor motor 201. The recording head 103 detects a position of the recording medium thus conveyed, and ejects ink based on recording data (image information) transmitted from the host PC (personal computer) 102, to thereby form an image on the recording medium. The recording medium on which the image has been formed is conveyed outside the ink jet recording apparatus 101, and stacked on the stacker 111. With this configuration, the recording medium contained in the recording medium tray 114 is contained inside the ink jet recording apparatus 101, and more specifically, contained in a position closer to the recording engine 105. Accordingly, even in a case where the ink jet recording apparatus 101 is not used for a long period of time, the recording medium contained in the recording medium tray 114 is hardly exposed to outside air, and hence unsusceptible to change in humidity and temperature. Further, the recording medium contained in the recording medium tray 114 is contained in a position closer to the recording engine 105, and hence the recording medium positioned between the recording medium containing position and the recording engine 105 is also less likely to be exposed to outside air.

Figure 4:
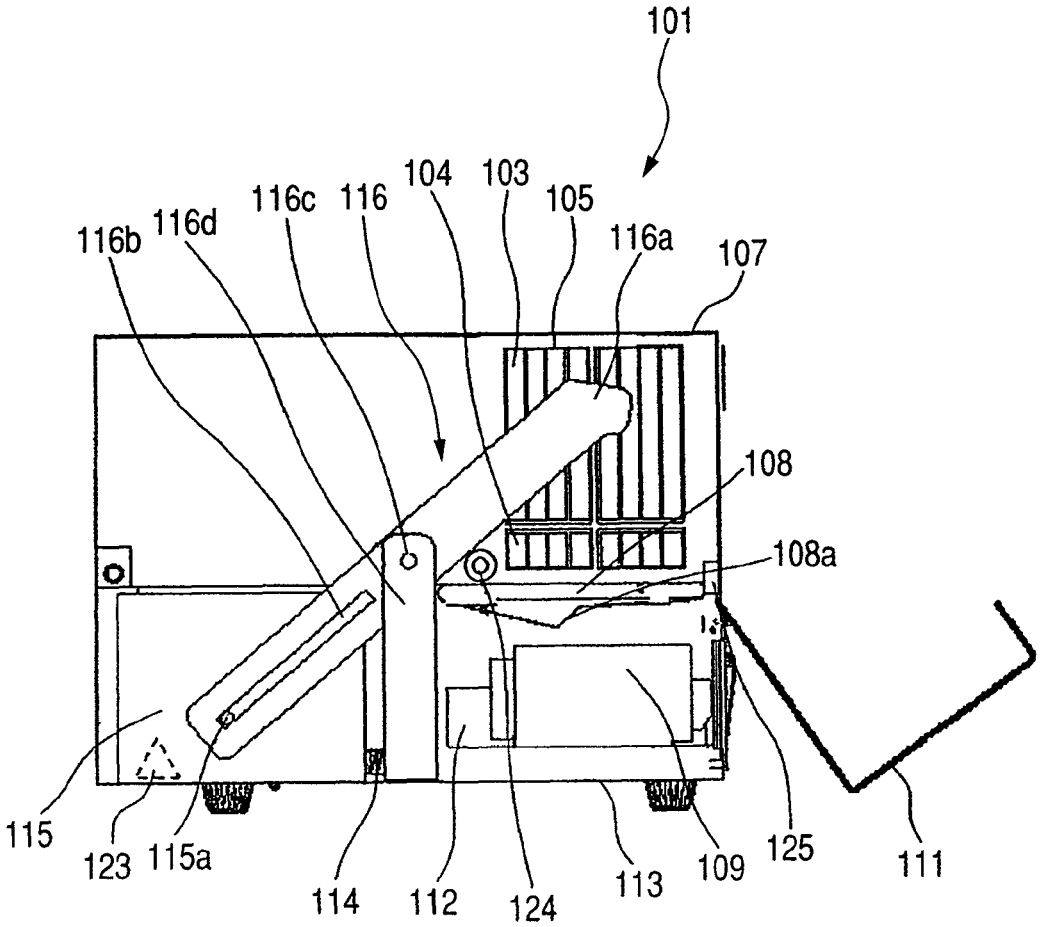
FIG. 4 is a left side sectional view of the ink jet recording apparatus.

FIG. 4 is a left side sectional view of the ink jet recording apparatus 101. Here, as illustrated in FIG. 4, the raising and lowering mechanism 116 includes a raising and lowering lever 116*a* having, at a tip end portion thereof, a grip portion to be held by an operator for operation, a shaft 116*c* serving as a center of rotation of the raising and lowering lever 116*a*, and a pillar 116*d* which is fixed to the base unit 113 and supports the shaft 116*c*. The raising and lowering lever 116*a* has a slit 116*b* formed in a lower portion thereof. The slit 116*b* is formed in a portion of the raising and lowering lever 116 opposite to the grip portion of the raising and lowering lever 116*a* with respect to the shaft 116*c*. Further, the recording medium holder 115 includes a raising and lowering support portion 115*a* which engages with the slit 116*b* of the raising and lowering lever 116*a*. With this configuration, when the operator performs operation to turn clockwise the raising and lowering lever 116*a*, the slit 116*b* presses up the raising and lowering support portion 115*a*, and the recording medium holder 115 is moved up along with the movement of the raising and lowering support portion 115*a*.

Figure 5:
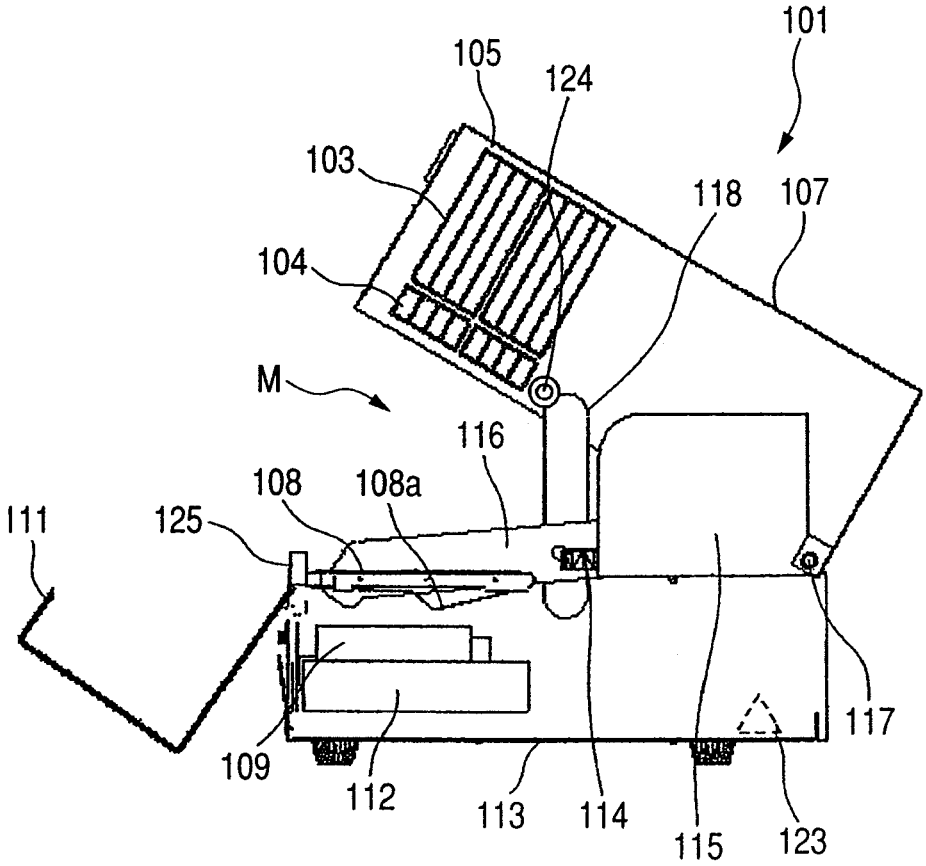
FIG. 5 is a right side sectional view of the ink jet recording apparatus in which the recording unit is opened.

FIG. 5 is a right side sectional view of the ink jet recording apparatus 101 in which the recording unit 107 is opened. The recording unit 107 includes a rotation shaft 117 formed at a lower end in the rear, which is on the upstream side in the recording medium conveying direction (upstream in the sheet conveying direction), and the recording unit 107 is configured to be freely openable and closable with respect to the base unit 113 through the rotation shaft 117. When the recording unit 107, which is supported by the base unit 113 at one end as described above, is opened, the recording unit 107 is raised on the front side of the ink jet recording apparatus 101, the ink jet recording apparatus 101 opens, on the front side thereof, like an alligator's mouth. When the recording unit 107 is opened as described above, the recording unit 107 is supported by the support member 118 to thereby remain opened. Note that, in a state in which the recording unit 107 remains opened as described above, the recording medium holder 115 may be moved up to a position above the recording medium feedable position through the operation of the raising and lowering lever 116*a* performed by the operator. This position is hereinafter referred to as upper position. When the recording medium holder 115 is placed in the upper position, the recording medium holder 115 is positioned upstream of the recording medium conveying unit 108 in the recording medium conveying direction. As described later, the recording medium holder 115 may be moved to the above-mentioned upper position even in a case where the recording medium tray 114 is not moved, to thereby allow the operator to contain and take out the recording medium from the front with ease.

Figure 6:
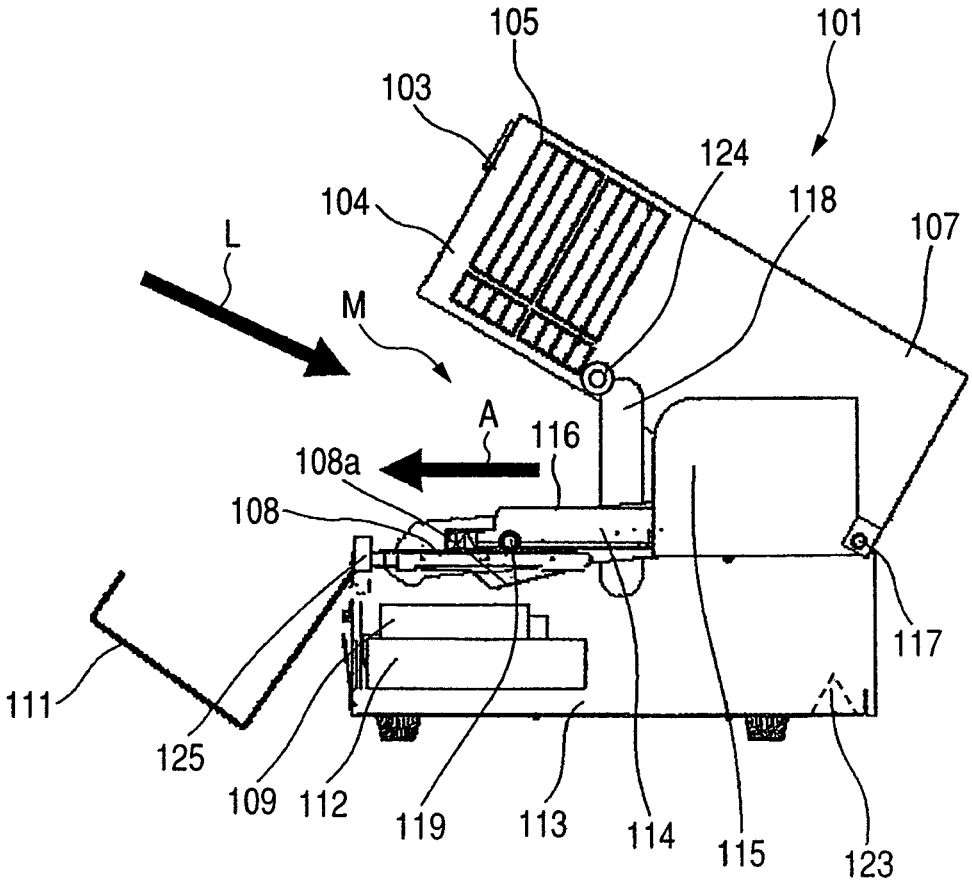
FIG. 6 illustrates the ink jet recording apparatus which is ready for containing a recording medium.

Next, how to contain the recording medium in the ink jet recording apparatus 101 will be described below. Note that, in the following, a case of using a fan-fold paper as the recording medium will be described. FIG. 6 illustrates the ink jet recording apparatus 101 which is ready for containing the recording medium. First, the operator opens the recording unit 107 which is openable and closable. Then, the operator reaches by the hand into the ink jet recording apparatus 101 through an opening M, which lies downstream in the recording medium conveying direction, between the recording unit 107 and the base unit 113. The operator pulls out the recording medium tray 114, which is supported in a manner that the recording medium tray 114 may be pulled out (slidable) with respect to the recording medium holder 115 positioned in the above-mentioned upper position, in a direction indicated by the arrow A, which is a front direction (downstream direction in the recording medium conveying direction). This way allows the operator to place the recording medium tray 114 above the recording medium feedable position while moving the recording medium tray 114 to a recording medium loading position which lies downstream in the recording medium conveying direction. In other words, the recording medium loading position lies between the recording medium conveying unit 108 and the recording engine 105 thus moved up.

Figure 18:
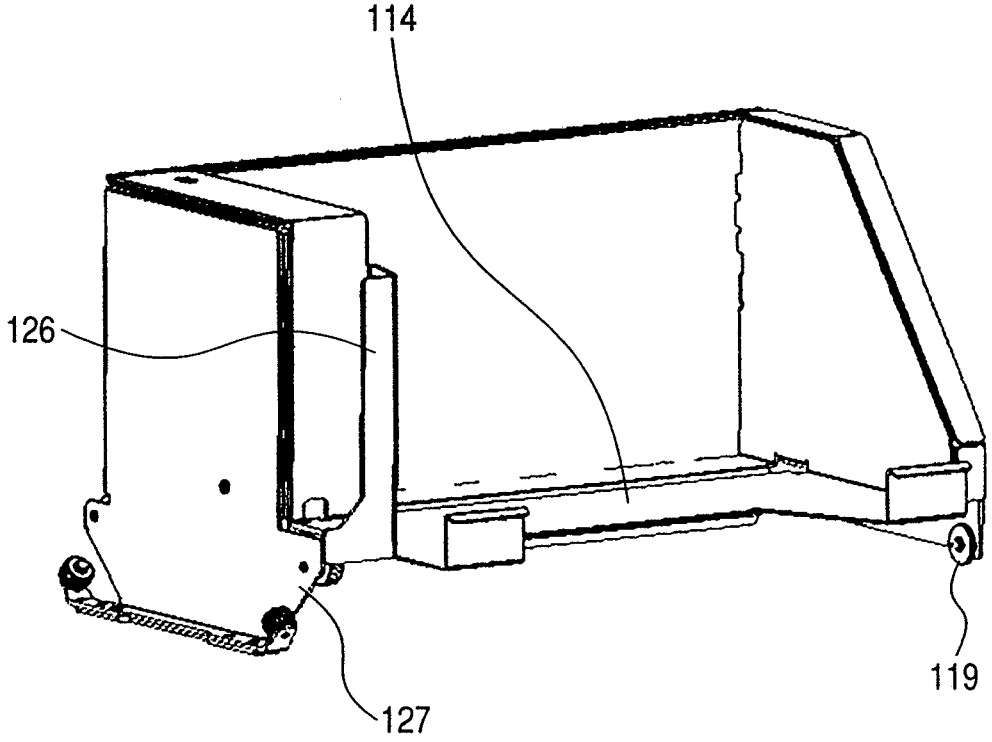
FIG. 18 is a perspective view illustrating a recording medium tray according to the first embodiment of the present invention.

FIG. 18 is a perspective view illustrating the recording medium tray 114.

Figure 7:
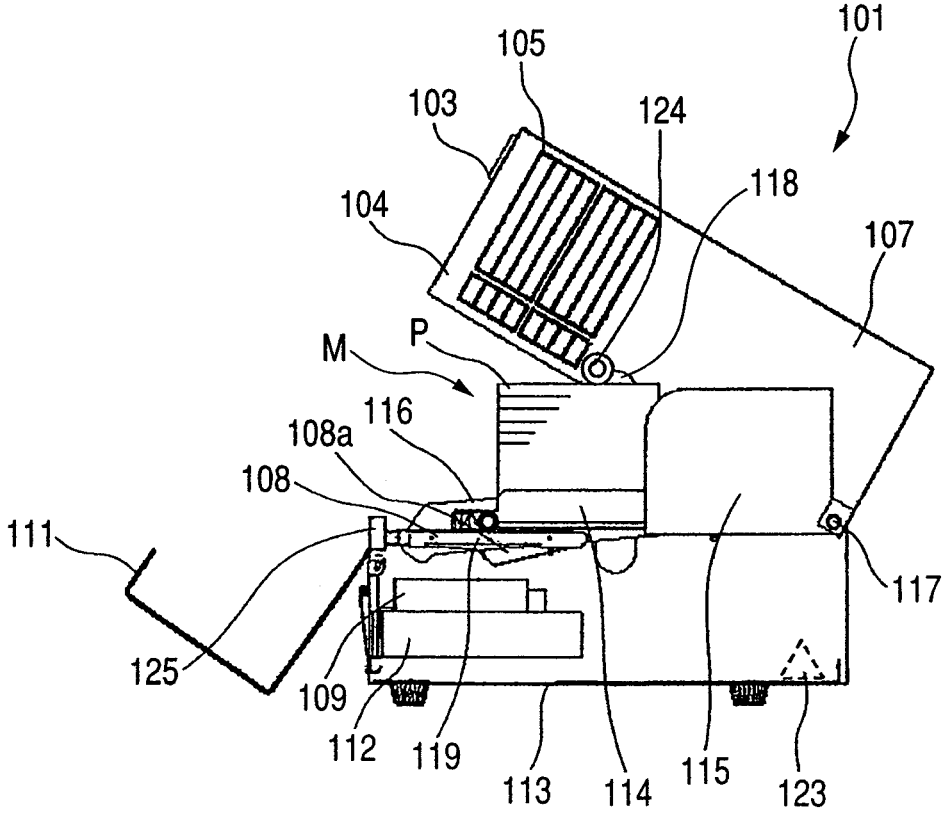
FIG. 7 illustrates how to load the recording medium into the ink jet recording apparatus.

The recording medium tray 114 is in a box-like shape, and holds recording media P (FIG. 7). The recording medium tray 114 is opened at the front thereof so that the operator can load and remove the recording media P with ease. The recording medium tray 114 is provided with a handy-grip portion 126 to be held by the operator for moving the recording medium tray 114 upstream or downstream in the conveying direction. The recording medium tray 114 is provided with a guide portion 127, and the guide portion 127 is guided along rails to be described later to thereby move upstream or downstream in the conveying direction.

Figure 19:
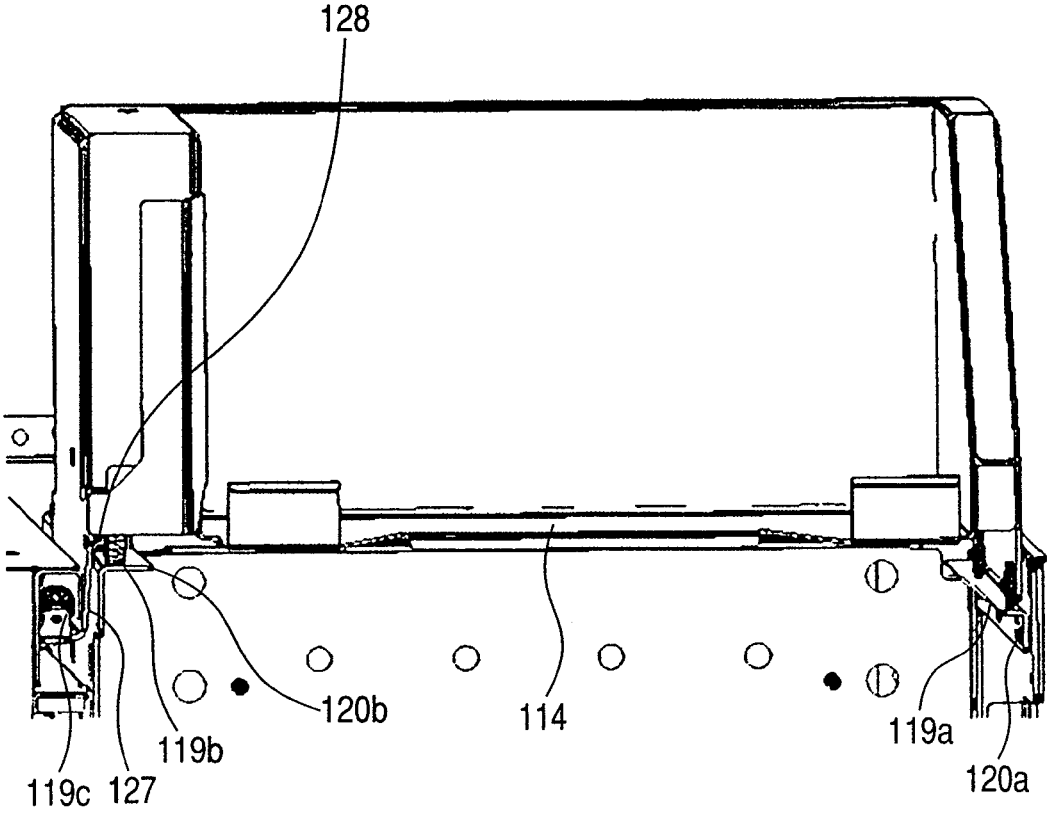
FIG. 19 is a perspective view illustrating the recording medium tray according to the first embodiment of the present invention which is guided along rails.

FIG. 19 is a perspective view illustrating the recording medium tray 114 which is guided along the rails. FIG. 19 is a front view of the recording medium tray 114.

The recording medium tray 114 is provided with rollers 119*a*, 119*b*, and 119*c*. Further, rails 120*a*, 120*b*, and a side regulating member 128 are provided in the ink jet recording apparatus 101. The roller 119*a* rolls on along the rail 120*a* while the roller 119*b* rolls on along the rail 120*b*, to thereby move the recording medium tray 114. The roller 119*c* provided on the guide portion 127 rolls inside the side regulating member 128. With this configuration, the recording medium tray 114 moves upstream and downstream in the conveying direction.

Figure 20:
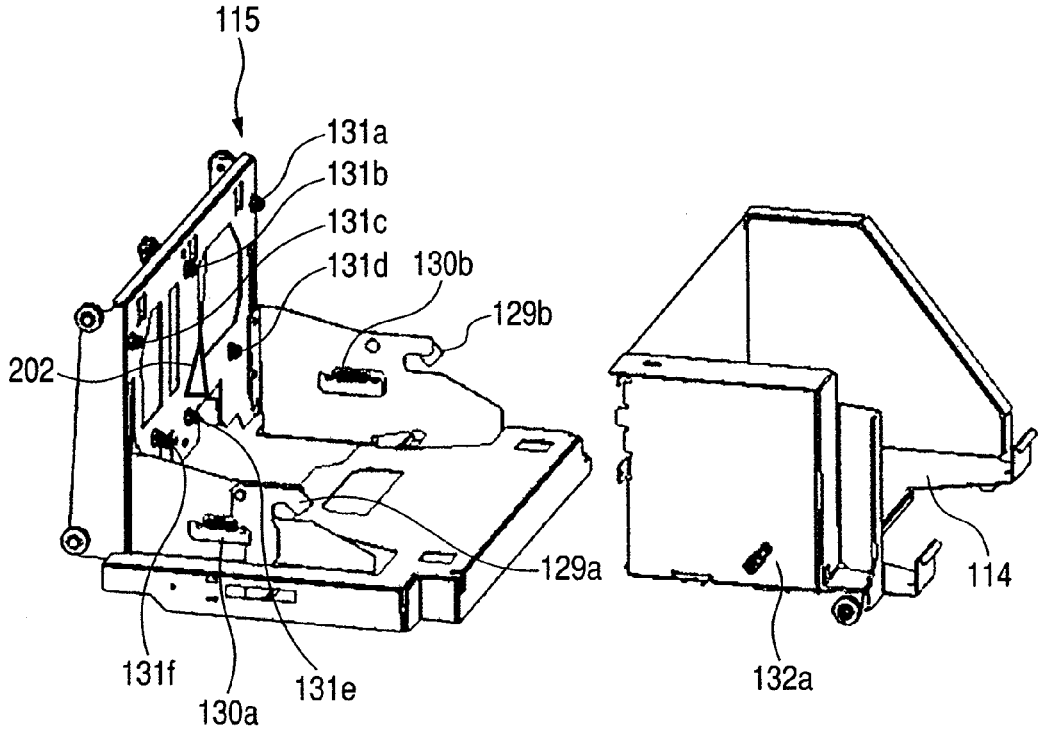
FIG. 20 is a perspective view illustrating a structure configured to fix the recording medium tray to the recording medium holder according to the first embodiment of the present invention.

FIG. 20 is a perspective view illustrating a structure configured to fix the recording medium tray 114 to the recording medium holder 115.

Inside the ink jet recording apparatus 101, the recording medium holder 115 is provided. Hooks 129*a* and 129*b* are disposed to be turnable with respect to a frame of the recording medium holder 115. The recording medium holder 115 is provided with the hooks 129*a* and 129*b*, which are biased by springs 130*a* and 130*b* so that the tip end portions of the hooks 129*a* and 129*b* are turned downward. The recording medium tray 114 has support plates provided on both sides in a width direction perpendicular to the conveying direction. On the support plates, shafts 132*a* and 132*b* are formed so as to protrude in a direction opposite to a direction toward the recording media placed on the recording medium tray 114. The shaft 132*b* (not shown) is formed on the support plate opposing to the support plate on which the shaft 132*a* is formed, so as to protrude in a direction opposite to the protruding direction of the shaft 132*a*. When the operator moves the recording medium tray 114 toward the rear (upstream in the conveying direction) of the ink jet recording apparatus 101, the shafts 132*a* and 132*b* move the tip end portions of the hooks 129*a* and 129*b* upward, respectively. After that, the tip end portions of the hooks 129*a* and 129*b* move down so as to engage with the shafts 132*a* and 132*b*, respectively. The recording medium tray 114 is held by the hooks 129*a* and 129*b* as being pressed against multiple abutting members 131*a*, 131*b*, 131*c*, 131*d*, 131*e*, and 131*f*. The recording medium holder 115 includes a tray switch 202. The tray switch 202 is turned on when the recording medium tray 114 is set in the recording medium holder 115. The tray switch 202 is turned off when the recording medium tray 114 is not set in the recording medium holder 115.

Further, the recording medium holder 115 and the recording medium tray 114 are provided with a recording medium tray anti-drop mechanism (not shown), which prevents the recording medium tray 114 from dropping out of the recording medium holder 115 in the movement of the recording medium holder 115. At this time, the operator can see the recording medium tray 114 through the opening M (FIG. 6) in a direction indicated by the arrow L. Note that, when the recording unit 107 is opened, a distance between the lower end portion of the recording engine 105 and an upper surface of the recording medium conveying unit 108 is designed to be larger than a maximum height of the recording media P to be contained in the recording medium tray 114 placed in the recording medium feedable position.

Note that, in the first embodiment, the recording medium tray 114 is pulled out manually. However, the recording medium tray 114 may be pulled out, rather than through such a manual mechanism, but through a moving mechanism (not shown) which may be driven by an operation made through an operation panel 106. Alternatively, there may be conceivable another configuration, in which the recording medium tray 114 may be mechanically pulled out in association with the movement of the recording unit 107.

FIG. 7 illustrates how to load the recording medium into the ink jet recording apparatus 101. When the recording medium tray 114 is pulled out to be placed in the recording medium loading position, the recording media P are inserted through the opening M to be contained in the recording medium tray 114. This configuration allows the operator to see the series of operation of containing the recording media P, and hence the operator may reliably contain (load) the recording media P. Further, the recording media P may be contained without being carried above all the way across the ink jet recording apparatus (recording unit), and hence the recording media P may still be easy to contain even when a recording media stack is relatively increased in size and weight. Accordingly, the recording media P may be contained without placing limitations on the power and the height of the operator.

Figure 8:
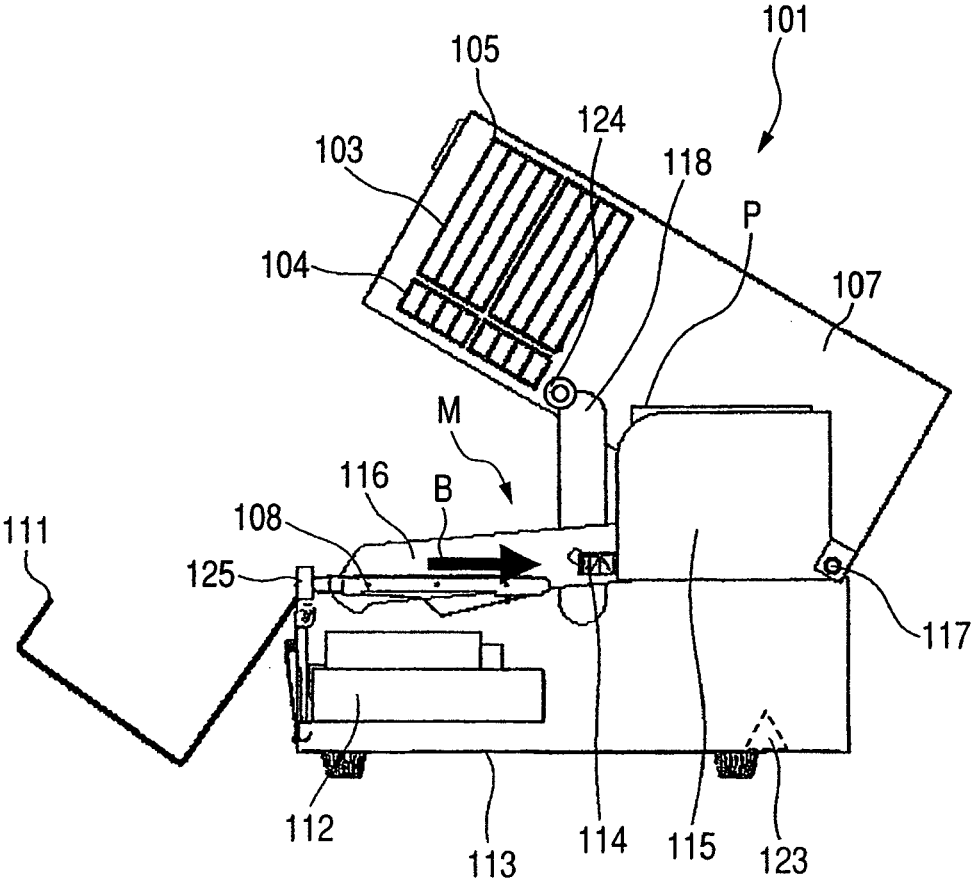
FIG. 8 illustrates the ink jet recording apparatus in which a recording medium tray is set in a recording medium holder.

FIG. 8 illustrates the ink jet recording apparatus 101 in which the recording medium tray 114 is set in the recording medium holder 115. In this case, after the recording media P are contained in the recording medium tray 114, the recording medium tray 114 is pushed into a direction indicated by the arrow B toward the rear of the ink jet recording apparatus 101, and set in the recording medium holder 115 at the above-mentioned upper position.

Figure 9:
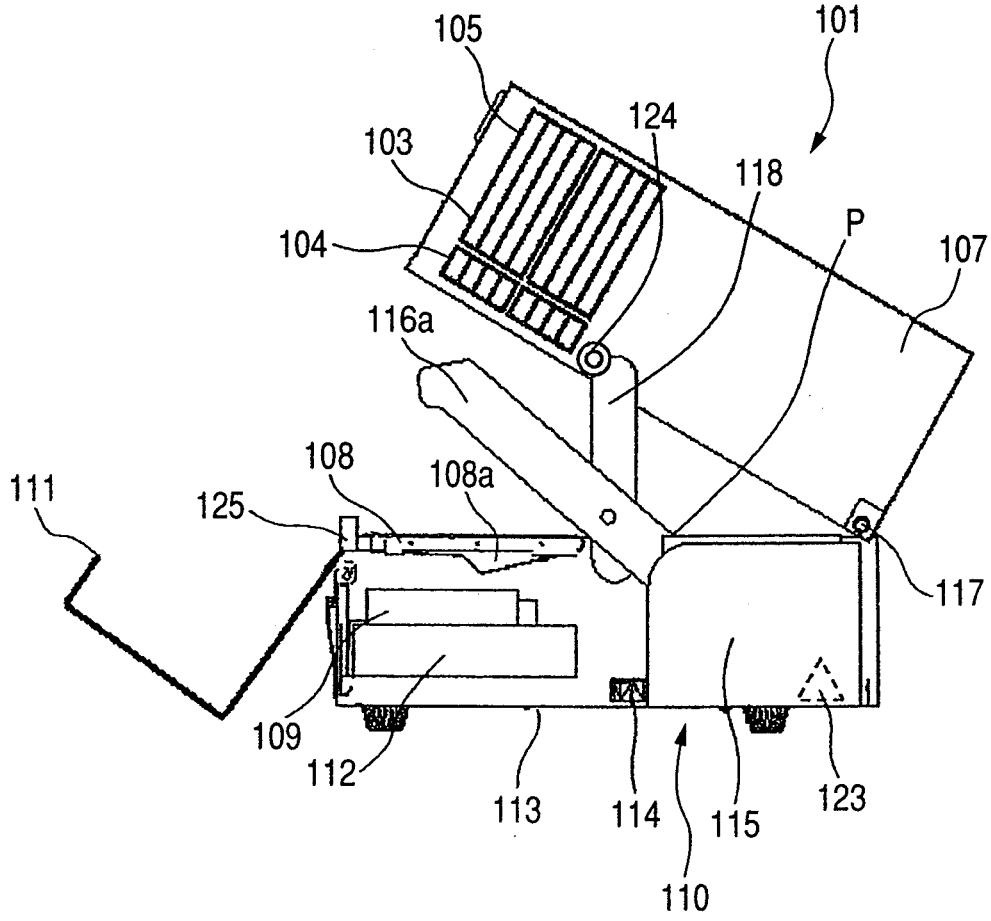
FIG. 9 illustrates the ink jet recording apparatus in which the recording medium feeding unit is set in a feedable position.
Figure 10:
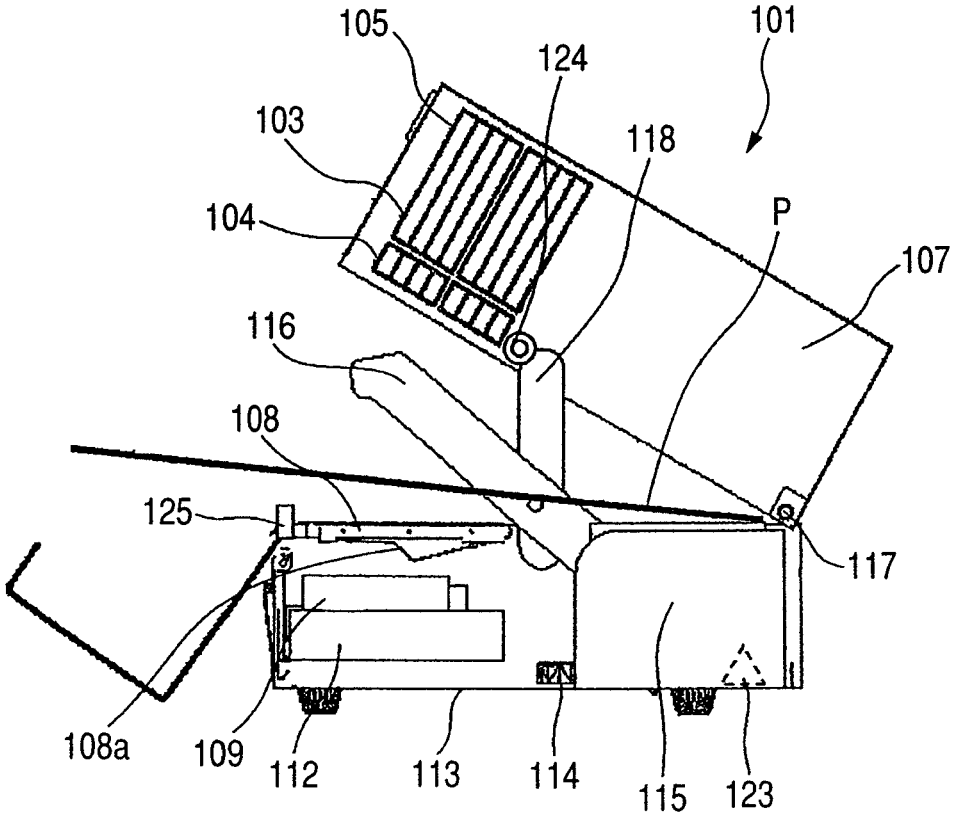
FIG. 10 illustrates how to set the recording medium on a conveying unit in the ink jet recording apparatus.

FIG. 9 illustrates the ink jet recording apparatus 101 in which the recording medium feeding unit 110 is set in the recording medium feedable position. The operator pushes the recording medium tray 114 in a direction toward the rear of the ink jet recording apparatus 101, so that the recording medium tray 114 is set in the recording medium holder 115 at the above-mentioned upper position. After that, when the support member 118 supporting the recording medium holder 115 is released by the operator, the recording medium holder 115 is moved down due to the self weight of the recording medium holder 115, or through the operation of the raising and lowering lever 116*a* performed by the operator, so as to be set in the recording medium feedable position. FIG. 10 illustrates how to set the recording medium P on the recording medium conveying unit 108. A recording medium leading end portion in an upper part of the recording medium stack contained in the recording medium tray 114 is pulled out by the operator to pass through above the recording medium conveying unit 108 toward the front of the ink jet recording apparatus 101, and set onto the recording medium conveying unit 108.

Figure 11:
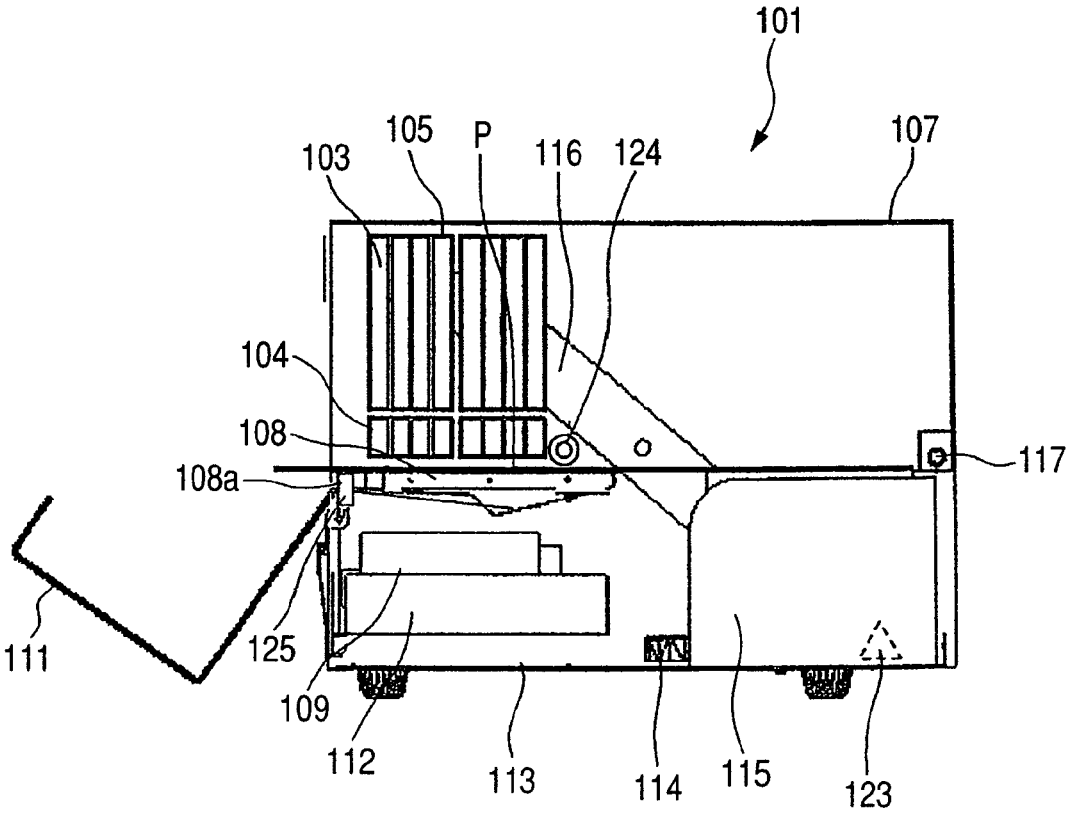
FIG. 11 illustrates the ink jet recording apparatus in which the sheet supplying operation is completed and the recording unit is closed.

FIG. 11 illustrates the ink jet recording apparatus 101 in which the sheet supplying operation is completed and the recording unit 107 is closed thereafter. Note that, below the recording medium holder 115, there is provided a recording medium sensor 123 configured to detect whether or not the recording medium P is contained in the recording medium tray 114 placed in the recording medium feedable position. Further, the base unit 113 includes an open and close sensor 125 configured to detect whether the recording unit 107 is opened or closed. In the first embodiment, the sensors 123 and 125 employ mechanical sensors.

When the recording unit 107 is opened, the open and close sensor 125 protrudes upward. When the recording unit 107 is closed, the open and close sensor 125 is pushed down by the recording unit 107. The change in state of the open and close sensor 125 allows a control portion (not shown) to detect that the recording unit 107 is closed.

Here, the control portion performs control so that the recording medium P may be conveyed by the recording medium conveying unit 108 and printing may be performed by the recording engine 105 only when the recording medium sensor 123 has detected that the recording medium P is contained in the recording medium tray 114 and when the open and close sensor 125 has detected that the recording unit 107 is closed. When the recording unit 107 is opened, it is displayed on the operation panel 106 that the recording unit 107 is opened. Furthermore, when no recording medium is left in the recording medium feeding unit 110 after being successively used, the conveyance and the printing of the recording medium are stopped. Then, it is displayed on the operation panel 106 that no recording medium is left. Note that, according to the description of the first embodiment, the presence or absence of the recording medium P and the opening and closing of the recording unit 107 are displayed on the operation panel 106. However, the present invention is not limited thereto, and such information may be provided by using a light emitting device (LED), a warning tone, a warning unit, or the like.

When the recording unit 107 is closed after the recording media P are contained, the recording media P thus contained are pressed down against the recording medium conveying unit 108 by the pinch rollers 124 included in the recording unit 107. Here, the recording medium conveying unit 108 includes one or more conveyor belts 108*a*, and the recording medium P is conveyed along with the rotation of the conveyor belt 108*a*. As described above, the pinch rollers 124 press down the upper surface of the recording medium P while the conveyor belt 108*a* holds the lower surface of the recording medium P, and the pinch roller 124 and the conveyor belt 108*a* both rotate while sandwiching the recording medium P therebetween, to thereby convey the recording medium P. Alternatively, a sucking portion may be provided underneath the conveyor belt 108*a* so that the recording medium P may be conveyed while being suctioned to the conveyor belt 108*a*. In this case, the pinch rollers 124 are unnecessary.

Figure 12:
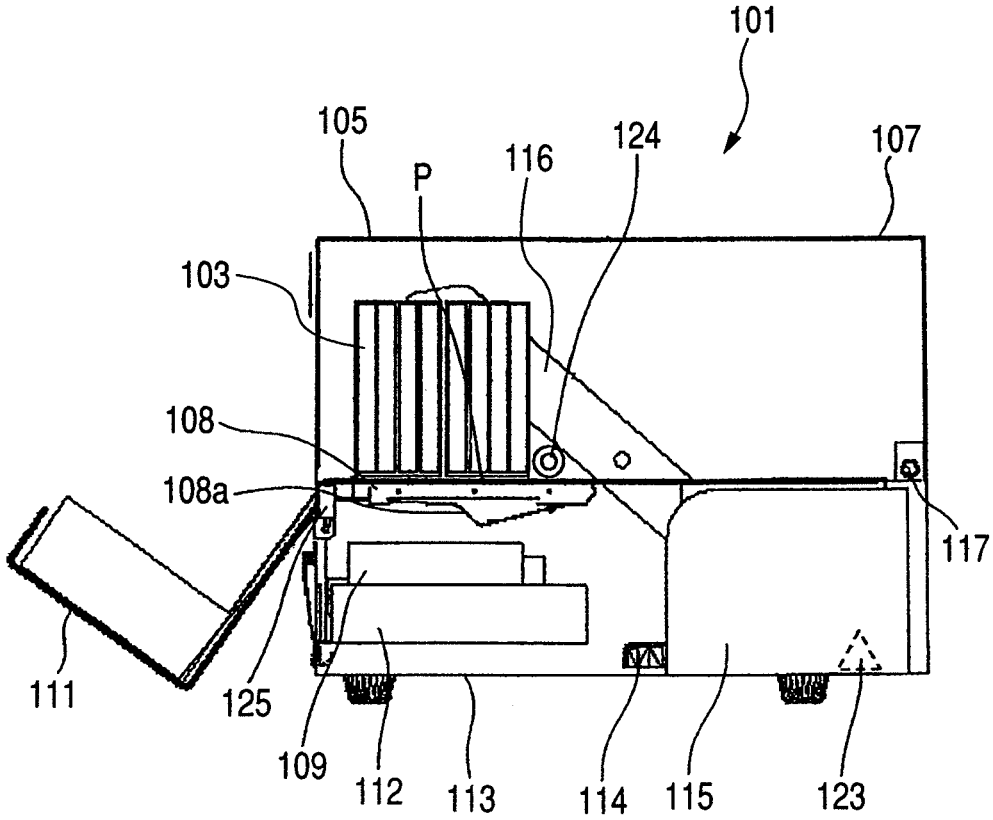
FIG. 12 illustrates the ink jet recording apparatus in printing operation.

FIG. 12 illustrates the ink jet recording apparatus 101 in printing operation. The recording medium P conveyed by the recording medium conveying unit 108 is conveyed below the recording head 103. At this time, the recording head 103 is moved down to a printing position, and the recovery unit 104 of the recording unit 107 is retracted from a position immediately below the recording head 103, in a width direction of the recording medium P conveyed by the recording medium conveying unit 108. Then, the recording head 103 detects the position of the recording medium P thus conveyed, and ejects ink based on recording data (image information) transmitted from the host PC (personal computer) 102, to thereby form an image on the recording medium P. The recording medium P having the image formed thereon is conveyed outside the ink jet recording apparatus 101, and stacked on the stacker 111.

Figure 13:
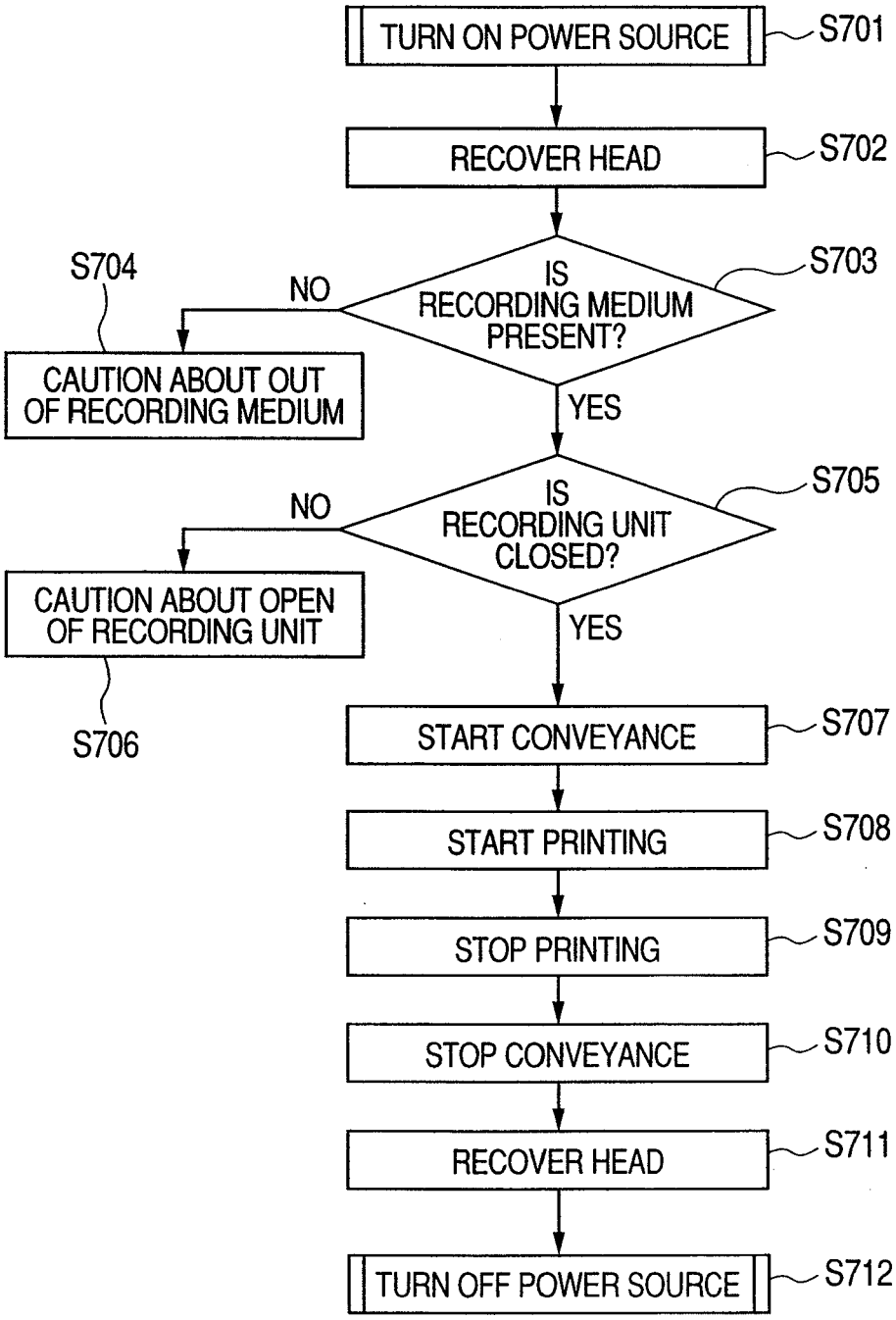
FIG. 13 is a flow chart illustrating control to be performed during the printing operation of the ink jet recording apparatus.

FIG. 13 is a flow chart illustrating control to be performed during the printing operation of the ink jet recording apparatus 101. The flow chart is shared in common by a second embodiment, a third embodiment, and a fourth embodiment to be described later. In the ink jet recording apparatus 101, when a power source is turned on (S701), the recording head 103 is recovered (S702). After that, the presence or absence of the recording medium is detected (S703), and in the case where no recording medium is left (NO in S703), an out of paper warning is given (S704). In the case where the recording medium is available (YES in S703), the opening and closing of the recording unit is detected next (S705).

Here, in the case where the recording unit 107 is opened (NO in S705), a recording unit open warning is given (S706). In, the case where the recording unit is closed (YES in S705), the conveyance of the recording medium is started (S707). Then, the recording head 103 ejects ink based on data transmitted from the PC, to thereby form an image on the recording medium (S708). When the image formation based on the transmitted data is completed, printing is stopped (S709). Further, the conveyance of the recording medium is stopped each time (S710), and the recording head 103 is recovered (S711). Further, the power source is turned off (S712).

As described above, in the first embodiment, the recording unit 107 is left open, which allows the recording media to be set in the recording medium tray 114 by the operation performed through the opening M. Further, the recording medium P is delivered in front of the ink jet recording apparatus main body after printing, and hence operations of confirming the results of the printing and taking out the recording medium may be performed in front of the apparatus main body. This configuration attains easy-to-use front sheet feeding and front sheet delivery, a reduction in installation space of the apparatus in the sheet delivery direction, ease of confirming the results of printing, and an improvement in workability when taking out the printed recording medium.

Figure 14:
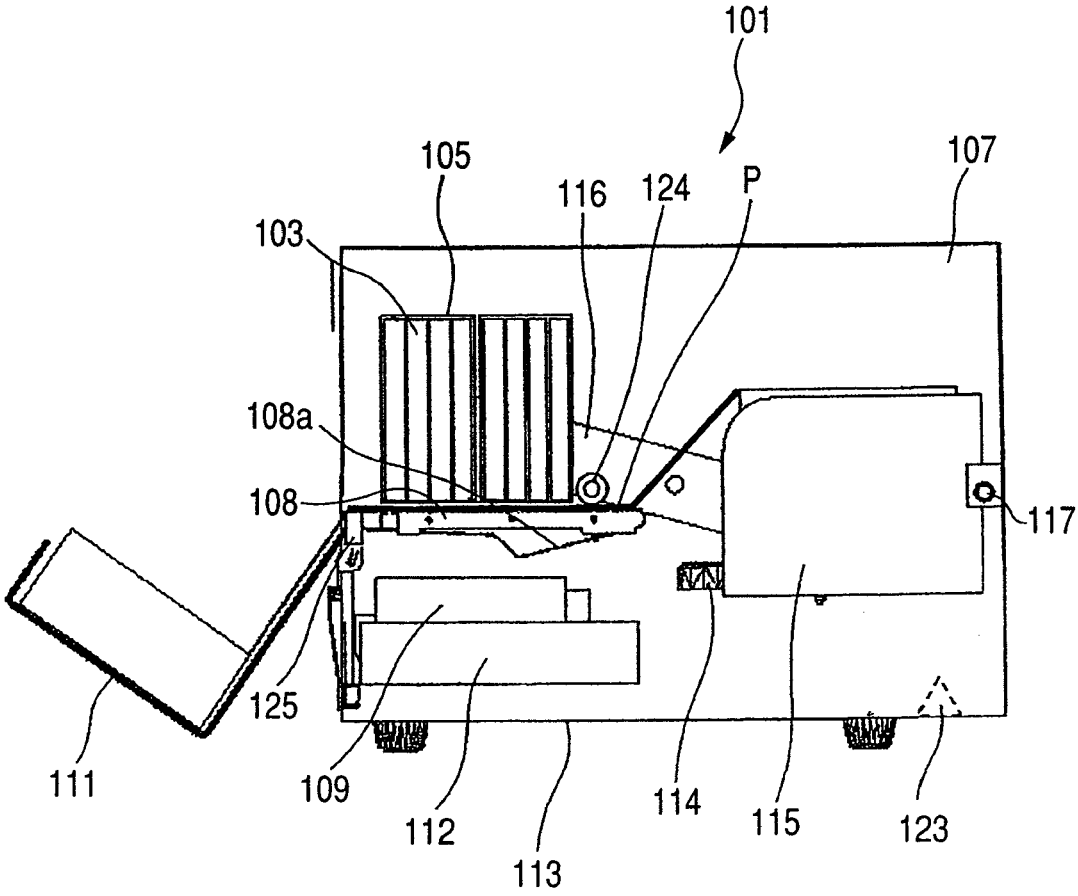
FIG. 14 illustrates the ink jet recording apparatus in which the recording medium holder is adjusted in height.

Note that, in the first embodiment, the recording medium holder 115 is adjustable in height according to the type, the condition, and the stacked amount of the recording media P, through a height adjustment mechanism (not shown) controlled by the control portion. FIG. 14 illustrates the ink jet recording apparatus 101 in which the recording medium holder 115 is adjusted in height by the height adjusting mechanism, so that the fan-fold paper sheet may be appropriately fed. FIG. 14 illustrates a state in which the recording medium holder 115 is adjusted to be placed in a position capable of performing sheet feeding appropriately from a full stacked state of the recording medium to the last trailing edge thereof.

According to the first embodiment, the image forming apparatus includes, in the apparatus main body, the holder configured to support the recording medium and the raising and lowering mechanism configured to raise and lower the holder, so as to open the recording unit of the apparatus main body, to thereby allow the recording media to be set in the holder by operation performed through the opening. Accordingly, the workability is improved when the recording medium is contained and taken out.

Figure 15:
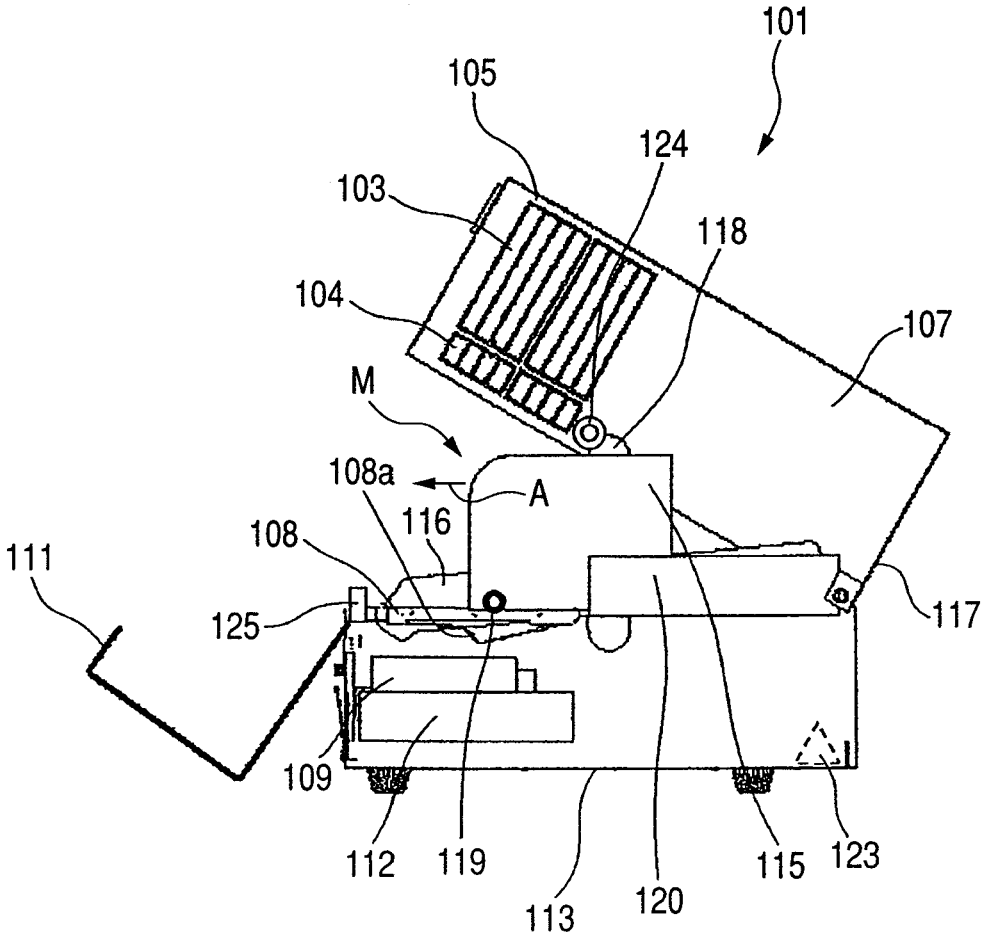
FIG. 15 is a side sectional view schematically illustrating an ink jet recording apparatus as an example of an image forming apparatus according to a second embodiment of the present invention.

Next, the second embodiment of the present invention will be described. FIG. 15 is a side sectional view schematically illustrating an ink jet recording apparatus as an example of an image forming apparatus 101 according to the second embodiment. In FIG. 15, the same reference symbols as those of FIG. 5 described above denote the same or corresponding portions. Here, in the second embodiment, the recording medium tray 114 is not provided, and the recording medium P is directly contained in the recording medium holder 115. Accordingly, when containing the recording medium P, the recording medium holder 115 is pulled out in a front direction of the ink jet recording apparatus.

In the configuration as described above, when containing the recording medium, the recording unit 107 is first opened upward with respect to the recording medium conveying unit 108, to thereby form the opening M in the form of an alligator's mouth. After that, the raising and lowering mechanism 116 raises the recording medium holder 115 to the upper position above the recording medium feedable position. Then, the operator reaches by the hand into the ink jet recording apparatus 101 from the front thereof, that is, through the opening M formed by the recording unit 107, and pulls out the recording medium holder 115 in the front direction, that is, the direction indicated by the arrow A, to thereby place the recording medium holder 115 to the recording medium loading position.

Note that, the raising and lowering mechanism 116 is provided with a rail 120, and the recording medium holder 115 is pulled out by the operator in the front direction along the rail 120. Further, a roller 119 is provided to the bottom surface of the recording medium holder 115, and the roller 119 allows the recording medium holder 115 to move smoothly on the recording medium conveying unit 108. Further, the recording medium holder 115 and the raising and lowering mechanism 116 are provided with a recording medium holder anti-drop mechanism (not shown), which prevents the recording medium holder 115 from falling off from the raising and lowering mechanism 116 while the raising and lowering mechanism 116 is moved.

Figure 16:
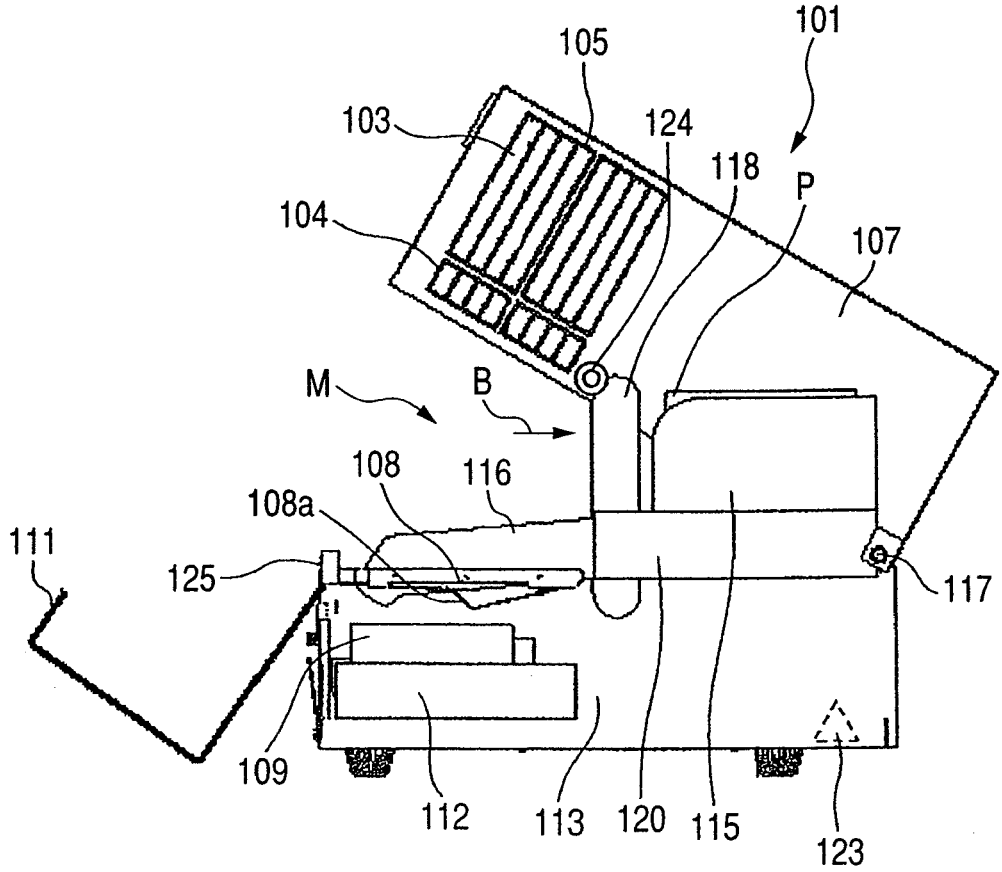
FIG. 16 illustrates the ink jet recording apparatus in which the recording medium holder is set.

When containing a fan-fold paper as the recording medium P, the recording medium P is inserted from the opening M in front of the ink jet recording apparatus, and contained on the recording medium holder 115. After the recording medium P is contained, as illustrated in FIG. 16, the recording medium holder 115 is pushed to the rear of the ink jet recording apparatus 101, in a direction indicated by the arrow B. The subsequent operation of conveying the recording medium P and the printing process are similarly performed as in the first embodiment.

As described above, in the second embodiment, the recording medium tray 114 is not provided, and the recording medium is directly contained in the recording medium holder 115. With this configuration, the number of components may be reduced, which leads to cost reduction.

Figure 17:
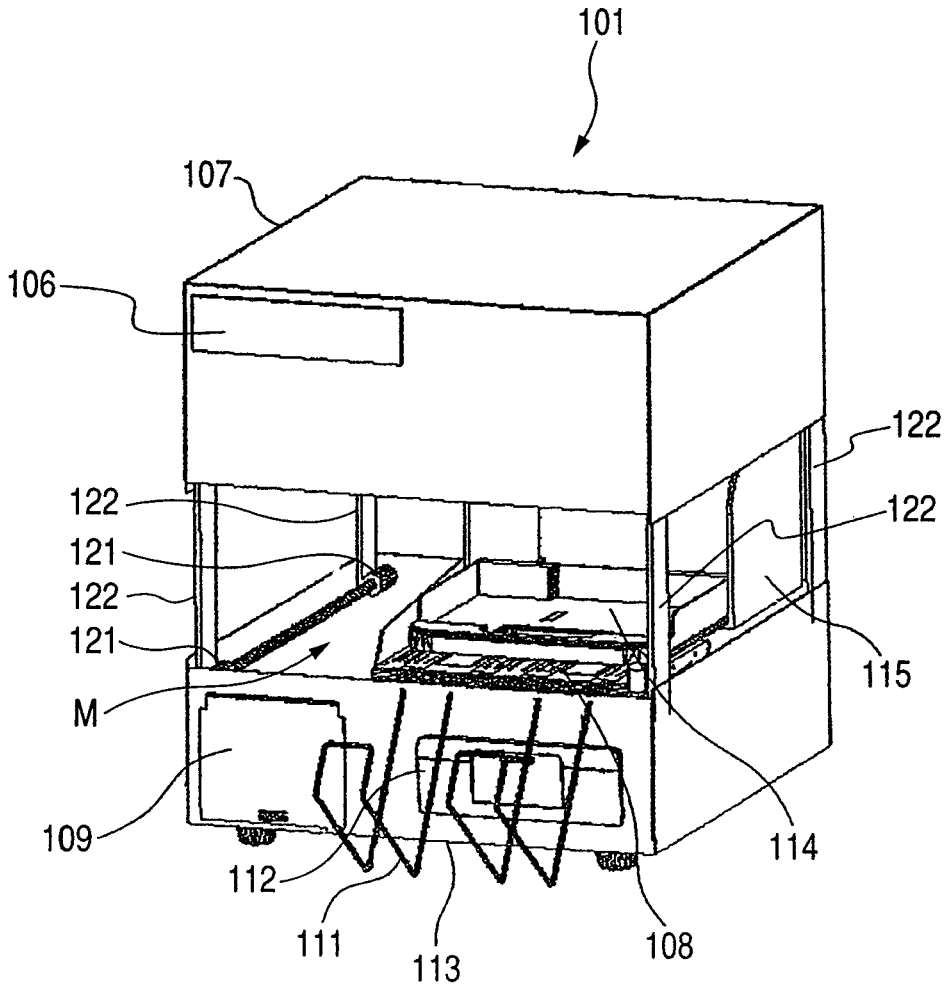
FIG. 17 is a perspective view schematically illustrating an ink jet recording apparatus as an example of an image forming apparatus according to a third embodiment of the present invention.

Next, the third embodiment of the present invention will be described. FIG. 17 is a perspective view schematically illustrating an ink jet recording apparatus as an example of an image forming apparatus 101 according to the third embodiment of the present invention. In FIG. 17, the same reference symbols as those of FIG. 5 described above denote the same or corresponding portions. In the second embodiment, the recording unit 107 is raised as being kept in the horizontal state.

In FIG. 17, the base unit 113 includes multiple pinion gears 121. Rack gears 122 extending in a vertical direction are provided at the four corners of the bottom surface of the recording unit 107, and mesh with the pinion gears 121. Then, when a raising signal for raising the recording unit 107 is input from the host PC 102 or the operation panel 106, the pinion gears 121 rotate, and the recording unit 107 is raised as being substantially parallel to the base unit 113 via the rack gears 122. When the recording unit 107 serving as the upper unit, is raised as described above with respect to the base unit 113 serving as the lower unit, the opening M is formed between the upper unit and the lower unit. The opening M formed as described above allows the operator to perform sheet supplying operation through the opening M. Note that, the raising mechanism in this embodiment includes a rack and pinion gear, but may obviously include other various forms, such as a mechanism in which a shaft and a spring are used in combination.

Next, the fourth embodiment of the present invention will be described. Reference symbols described in the above-mentioned embodiments denote the same portions in the fourth embodiment, and the description thereof is omitted.

The fourth embodiment illustrates an example of the raising and lowering mechanism for the recording medium holder 115.

Figure 21:
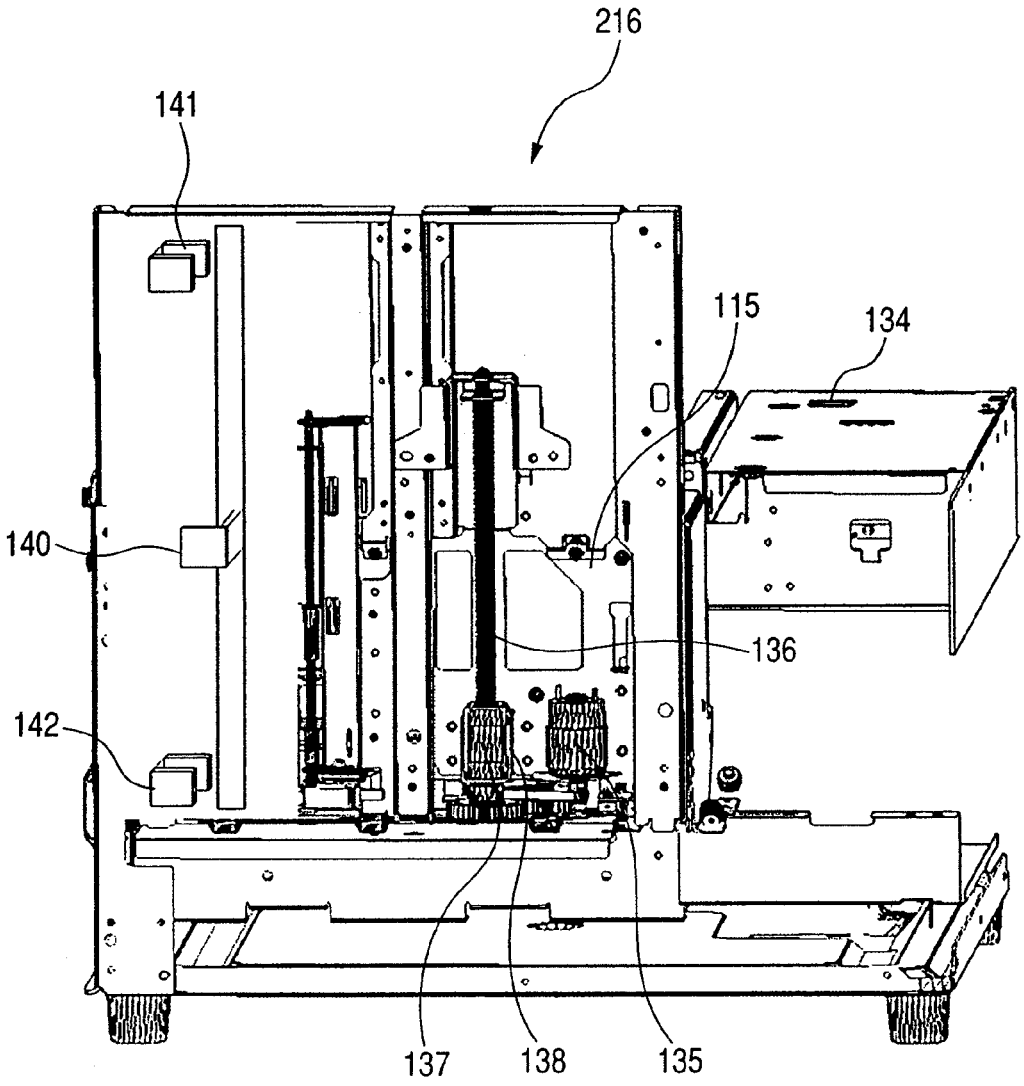
FIG. 21 is a perspective back view of a raising and lowering mechanism according to a fourth embodiment of the present invention.

FIG. 21 illustrates a raising and lowering mechanism 216, which is a perspective back view of the raising and lowering mechanism 216. When no sheet is left in the recording medium tray 114 on the recording medium holder 115, the operator turns the recording unit 107 upward, and then pushes a raising and lowering button 134. The raising and lowering button 134 is disposed inside the ink jet recording apparatus 101. When a central processing unit (CPU) 200 to be described later receives a signal from the raising and lowering button 134, the central processing unit (CPU) 200 causes a raising and lowering motor 135 to rotate, to thereby rotate, via a transmission means such as a belt or a pulley, a screw rod 136 having a screw part on the outer periphery thereof. A nut 137 rotatably provided on the screw part of the screw rod 136 is configured to move up along with a unidirectional rotation of the screw rod 136. A nut holder 138 is provided so as to cover the top and bottom of the nut 137. The nut holder 138 is configured to move up and down along with the upward and downward movement of the nut 137. The recording medium holder 115 is fixed to the nut holder 138. With the above-mentioned configuration, when the operator pushes the raising and lowering button 134, the raising and lowering mechanism 216 operates so that the recording medium holder 115 is moved up. Alternatively, when moving down the recording medium holder 115, the screw rod 136 is rotated in another direction so that the nut 137 is moved down. In association with the downward movement of the nut 137, the nut holder 138 and the recording medium holder 115 move down.

Next, an upper limit and a lower limit of the upward and downward movement of the recording medium holder 115 will be described. The recording medium holder 115 includes a raising and lowering flag 140. In association with the upward movement of the recording medium holder 115, the raising and lowering flag 140 moves up. The main body includes an upper limit sensor 141. When the raising and lowering flag 140 reaches the upper limit sensor 141, the raising and lowering motor 135 stops rotating, and hence the recording medium holder 115 is stopped at a predetermined upper limit position. The downward movement is similarly detected by a lower limit sensor 142, and the recording medium holder 115 stops at a predetermined lower limit position.

Figure 22:
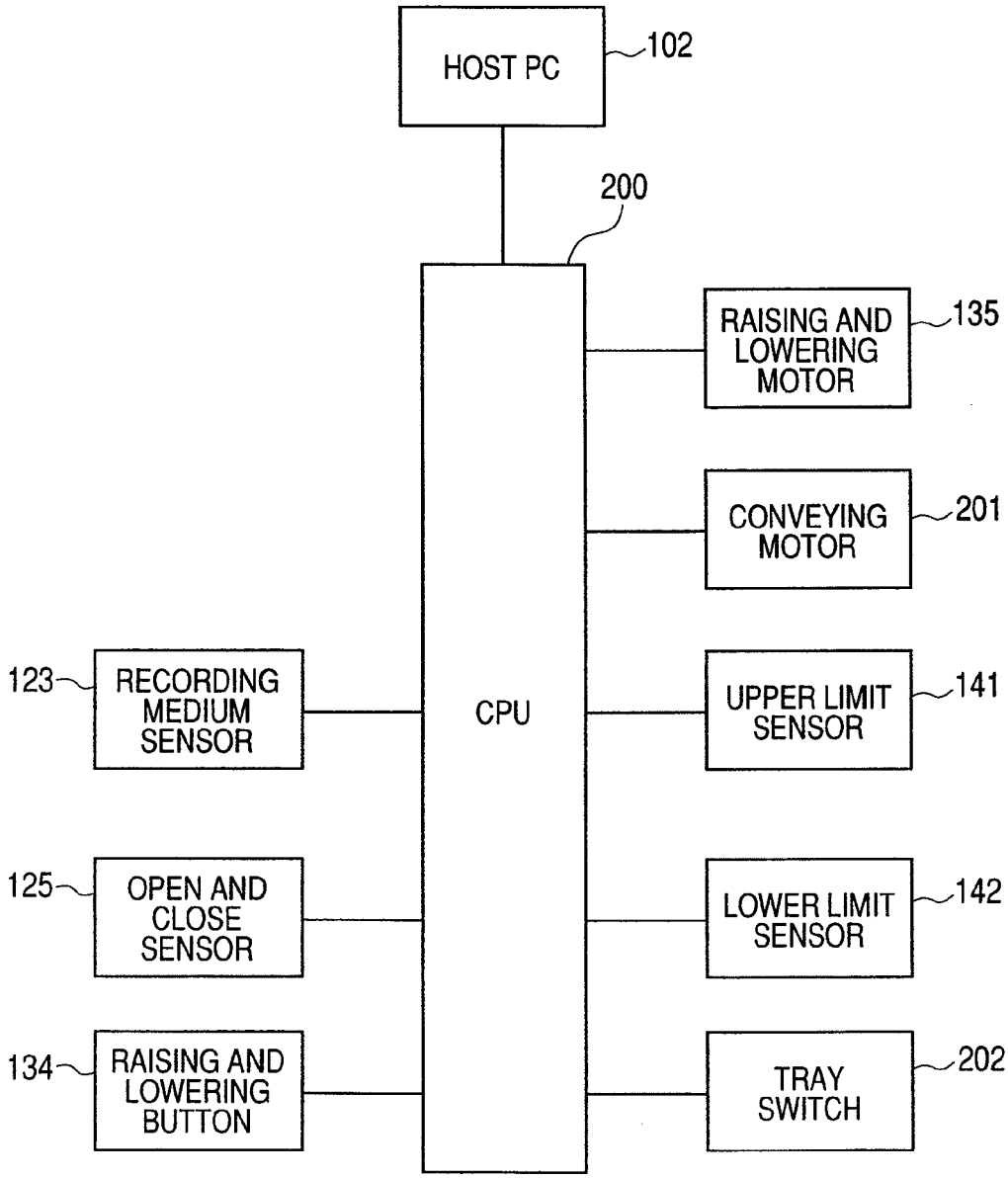
FIG. 22 is a block diagram of an image forming apparatus according to the fourth embodiment of the present invention.

FIG. 22 is a block diagram of the ink jet recording apparatus 101. The CPU 200 includes inside thereof a read-only memory (ROM) (not shown) storing a control program or the like corresponding to the flow charts of FIGS. 13 and 23 to be described later, and a random access memory (RAM) (not shown) serving as an area for temporarily holding control data and a work area for performing arithmetic computations necessary for the control. Here, to the CPU 200, the upper limit sensor 141, the lower limit sensor 142, the recording medium sensor 123, the open and close sensor 125, the tray switch 202, and the raising and lowering button 134 are connected. The CPU 200 is connected to the host PC 102. The CPU 200 is further connected to the raising and lowering motor 135 and the conveyor motor 201.

Figure 23:
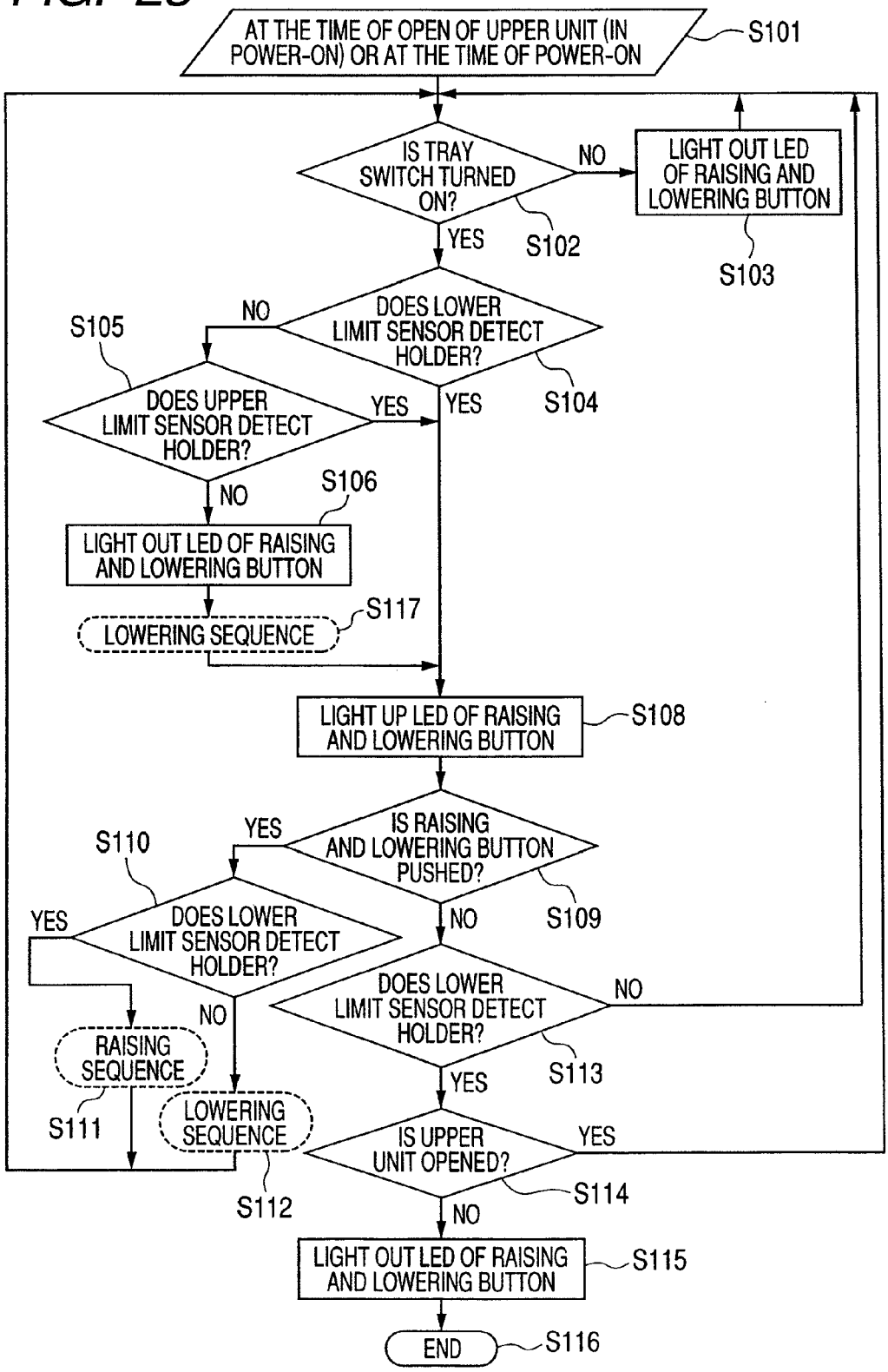
FIG. 23 is a flow chart for illustrating an operation of a recording medium tray according to the fourth embodiment of the present invention.

FIG. 23 is a flow chart for illustrating an operation of the recording medium tray 114.

In the case where the upper unit (recording unit 107) is opened (when the power source is turned on), or in the case where the power source is turned on (S101), the CPU 200 first checks whether or not the tray switch 202 is turned on (S102). In the case where the tray switch 202 is turned off (NO in S102), the CPU 200 puts out the LED of the raising and lowering button 134 (S103), and the processing returns to the step (S102) of checking whether or not the tray switch 202 is turned on.

In the case where the tray switch 202 is turned on (YES in S102), the CPU 200 checks whether or not the recording medium holder 115 is detected by the lower limit sensor 142 (S104). In the case where the recording medium holder 115 is not detected by the lower limit sensor 142 (NO in S104), the CPU 200 checks whether or not the recording medium holder 115 is detected by the upper limit sensor 141 (S105). In the case where the recording medium holder 115 is not detected by the upper limit sensor 141 (NO in S105), the CPU 200 puts out the LED of the raising and lowering button 134 (S106), and moves down the recording medium holder 115 to a position which allows the recording medium holder 115 to be detected by the lower limit sensor 142 (S107). Then, the CPU 200 stops moving down the recording medium holder 115 when the recording medium holder 115 is detected by the lower limit sensor 142, and lights up the LED of the raising and lowering button 134 (S108).

In the step of S105, when the recording medium holder 115 is detected by the upper limit sensor 141 (YES in S105), the CPU 200 lights up the LED of the raising and lowering button 134 (S108).

In the step of S104, the CPU 200 checks whether the recording medium holder 115 is detected by the lower limit sensor 142, and in the case where the recording medium holder 115 is detected by the lower limit sensor 142 (YES in S104), the CPU 200 lights up the LED of the raising and lowering button 134 (S108).

The CPU 200 lights up the LED of the raising and lowering button 134 in the step of S108, and then checks whether or not the raising and lowering button 134 is pushed (S109). The CPU 200 checks whether or not the recording medium holder 115 is detected by the lower limit sensor 142 (S110), and in the case where the recording medium holder 115 is detected by the lower limit sensor 142 (YES in S110), the CPU 200 raises the recording medium holder 115 until the upper limit sensor 141 detects the recording medium holder 115 (S111). Then, when the recording medium holder 115 has been detected by the upper limit sensor 141, the CPU 200 stops raising the recording medium holder 115, and the processing returns to the step of S103. At this time, the operator pulls out the recording medium tray 114 to the front side from the recording medium holder 115, so that the recording medium may be contained and taken out from the recording medium tray 114 with ease.

In the step of S110, in the case the recording medium holder 115 is not detected by the lower limit sensor 142 (NO in S110), the CPU 200 lowers the recording medium holder 115 until the lower limit sensor 142 detects the recording medium holder 115 (S112). Then, the CPU 200 stops lowering the recording medium holder 115 when the recording medium holder 115 has been detected by the lower limit sensor 142. In the case where the recording medium holder 115 is not detected by the lower limit sensor, the CPU 200 further lowers the recording medium holder 115, and the processing returns to the step of S103. At this time, the operator pushes the raising and lowering button 134 to raise the recording medium holder 115, and after that, the operator pulls out the recording medium tray 114 to the front side from the recording medium holder 115, so that the recording medium may be contained and taken out from the recording medium tray 114 with ease.

In the step of S109, in the case where the raising and lowering button 134 is not pushed (NO in S109), the CPU 200 checks whether or not the recording medium holder 115 is detected by the lower limit sensor 142 (S113). In the case where the recording medium holder 115 is not detected by the lower limit sensor 142 (NO in S113), the CPU 200 returns the processing to the step of S103.

In the step of S113, in the case where the recording medium holder 115 is detected by the lower limit sensor 142 (YES in S113), the CPU 200 checks whether or not the upper unit is opened (S114), and in the case where the upper unit is opened (YES in S114), the CPU 200 returns the processing to the step of S103.

In the step of S114, in the case where the upper unit is not opened (NO in S114), the CPU 200 puts out the LED of the raising and lowering button 134 (S115), and ends the processing (S116).

In the above, the case where the present invention is applied to a fan-fold paper is described. However, the printer according to the present invention may obviously take various forms, such as a printer employing, as a print medium, a label paper, a business card, or a card, a printer in the form of a ticket vending machine, and the like. Further, in the above, the ink jet recording apparatus is described as an example of the image forming apparatus. However, the present invention may be applied to an image forming apparatus such as a printer of an electrophotographic method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-262221, filed Nov. 17, 2009, and No. 2010-244603, filed on Oct. 29, 2010 which are hereby incorporated by reference herein in their entirety.

What is claimed is:

1. An image forming apparatus, comprising:

a recording unit configured to form an image on a recording medium which is conveyed in a predetermined conveying direction;

a main body portion configured to support said recording unit for movement between an open position and a closed position;

a conveying unit configured to convey, in the predetermined conveying direction, the recording medium on which an image is to be formed by said recording unit, said conveying unit being disposed below said recording unit;

a tray on which the recording medium on which the image is to be formed by said recording unit is placed;

a holder disposed upstream of said conveying unit in the predetermined conveying direction, provided in said main body portion and configured to hold said tray such that said tray can be pulled out from said holder;

a moving mechanism configured to move said holder upwardly from a position for feeding the recording medium to said recording unit; and a guide portion which guides said tray in being pulled out from said holder, wherein said guide portion is configured to guide said tray raised together with said holder by said moving mechanism downstream in the predetermined conveying direction.

2. An image forming apparatus according to claim 1, wherein said tray is guided by said guide portion to move between said conveying unit and said recording unit.

3. An image forming apparatus according to claim 1, wherein said recording unit opens and closes in a state in which said recording unit is supported at one end of said recording unit by said main body portion.

4. An image forming apparatus according to claim 1, wherein said recording unit opens and closes as being substantially parallel to said main body portion.

5. An image forming apparatus according to claim 1, wherein said holder is raised and lowered by said moving mechanism, away from and back to a position in which a feeding of the recording medium is appropriately performed.

6. An image forming apparatus according to claim 1, wherein said moving mechanism comprises a manual mechanism.

7. An image forming apparatus according to claim 1, wherein said moving mechanism raises and lowers said holder in association with a movement of said recording unit.

8. An image forming apparatus according to claim 1, wherein said main body portion comprises a sensor configured to detect a presence or absence of the recording medium.

9. An image forming apparatus according to claim 1, wherein said guide portion is configured to guide said tray downstream in the predetermined conveying direction in a case where said recording unit opens.

10. An image forming apparatus, comprising:

a recording unit configured to form an image on a recording medium which is conveyed in a predetermined conveying direction;

a main body portion configured to support said recording unit for movement between an open position and a closed position;

a conveying unit configured to convey, in the predetermined conveying direction, the recording medium on which an image is to be formed by said recording unit, said conveying unit being disposed below said recording unit;

a tray on which the recording medium on which the image is to be formed by said recording unit is placed;

a holder disposed upstream of said conveying unit in the predetermined conveying direction, provided in said main body portion and configured to hold said tray; and a guide portion configured to guide said tray downstream in the predetermined conveying direction, wherein said guide portion is configured to guide said tray between said conveying unit and said recording unit in a case where said recording unit opens.

* * * * *